US008083656B2

(12) United States Patent
Suiter

(10) Patent No.: US 8,083,656 B2
(45) Date of Patent: Dec. 27, 2011

(54) MULTI-FUNCTIONAL EXERCISE APPARATUS WITH ADJUSTABLE RESISTANCE

(76) Inventor: William Gene Suiter, Campbell, CA (US)

( * ) Notice: Subject to any disclaimer, the term of this patent is extended or adjusted under 35 U.S.C. 154(b) by 218 days.

(21) Appl. No.: 12/121,590

(22) Filed: May 15, 2008

(65) Prior Publication Data

US 2009/0062089 A1 Mar. 5, 2009

Related U.S. Application Data

(60) Provisional application No. 60/969,623, filed on Sep. 2, 2007.

(51) Int. Cl.
*A63B 21/04* (2006.01)
*A63B 21/02* (2006.01)

(52) U.S. Cl. ..... 482/130; 482/126

(58) Field of Classification Search ..... 482/122, 482/123, 127, 129, 130, 120, 126
See application file for complete search history.

(56) References Cited

U.S. PATENT DOCUMENTS

| | | | | | |
|---|---|---|---|---|---|
| 2,951,702 | A * | 9/1960 | Goodwin | 482/127 |
| 4,293,127 | A * | 10/1981 | Dudley | 482/120 |
| 4,484,741 | A * | 11/1984 | Bingisser | 482/114 |
| 4,844,420 | A * | 7/1989 | Oster | 256/1 |
| 5,125,649 | A * | 6/1992 | Fuller | 482/123 |
| 5,147,266 | A * | 9/1992 | Ricard | 482/131 |
| 5,662,564 | A * | 9/1997 | Nelson | 482/129 |
| 5,967,949 | A * | 10/1999 | Davenport | 482/93 |
| 6,015,371 | A * | 1/2000 | Davitt | 482/129 |
| 6,280,361 | B1 * | 8/2001 | Harvey et al. | 482/8 |
| 6,776,398 | B1 * | 8/2004 | Tsai | 256/45 |
| 6,827,675 | B1 | 12/2004 | Graham | |
| 6,929,587 | B2 * | 8/2005 | Charnitski | 482/110 |
| 6,929,589 | B1 * | 8/2005 | Bruggemann et al. | 482/138 |
| 7,150,682 | B2 * | 12/2006 | Varner | 473/257 |
| 2003/0022770 | A1 * | 1/2003 | Lee | 482/136 |
| 2003/0027696 | A1 | 2/2003 | Baumler et al. | |
| 2004/0204294 | A2 * | 10/2004 | Wilkinson et al. | 482/54 |
| 2005/0037902 | A1 | 2/2005 | Charnitski | |
| 2005/0268744 | A1 | 12/2005 | Embach et al. | |
| 2006/0166797 | A1 * | 7/2006 | Hamer | 482/121 |

FOREIGN PATENT DOCUMENTS

GB 2259864 A * 3/1993

OTHER PUBLICATIONS

U.S. Appl. No. 12/053,330, filed Mar. 21, 2008, William Gene Suiter.
My body. my life. mygym. fitness system. https://www.buymygym.com/home, Oct. 28, 2007.
My body. my life. mygym. fitness system. https://www.buymygym.com/pages/faqs---new, Oct. 28, 2007.
Suzanne Somers ThighMaster Gold. http://www.asseenontv.com/prod-pages/thighmaster_gold.html, Oct. 5, 2007.
Suzanne Somers Toning System. http://www.asseenontv.com/prod-pages/suzanne-somers-toning-sys..., Oct. 31, 2007.

* cited by examiner

*Primary Examiner* — Allana Lewin
(74) *Attorney, Agent, or Firm* — David R. Stevens; Stevens Law Group

(57) ABSTRACT

The invention is directed to an exercise apparatus with adjustable resistance, the exercise apparatus comprising a column, a spooling device coupled to the column, and an elastic member coupled to the spooling device, wherein movement of the elastic cord is permitted and the spooling device is configured to be rotatably adjustable to limit the movement of the elastic member.

17 Claims, 30 Drawing Sheets

MULTI-FUNCTIONAL EXERCISE APPARATUS WITH ADJUSTABLE RESISTANCE

RELATED APPLICATIONS

This application claims priority based on U.S. Provisional Application No. 60/969,623, filed on Sep. 2, 2007, entitled "Multi-Functional Exercise Apparatus with Adjustable Resistance."

BACKGROUND OF THE INVENTION

Exercise machine shave become apart of the modern everyday routine. This phenomenon is evidenced in the demand today for fitness centers, at-home exercise and weight machines, and various other exercise-related products. Many of the available multi-use exercise machines are large, heavy, not easily moveable, and space-consuming. Consumers with space limitations in their homes may not wish to take up a large portion of a room to dedicate to fitness equipment. In addition, the designs of these large machines lend to high cost of manufacturing, and thus unaffordability for many consumers. Although there are various smaller exercise machines available, these tend to focus on a limited number of muscle groups, and do not provide versatility for a multi-faceted exercise routine.

Another limitation of many available exercise machines is their relatively large difference between each degree of change in resistance. For example, if a user wishes to increase or decrease resistance, he is often required to alter the current setting by a difference of 5 or 10 lbs., or perhaps to a higher or lower "level" as preset by the equipment manufacturer. This may not be ideal for physical therapy, for those of a smaller frame, or in any situation in which a small increment of resistance change is desired.

One available device called the MyGym System, see https://www.buymygym.com/, allows for a variety of exercises to be performed. The MyGym allows for variable resistance through the use of various elastic bands, where one elastic band may offer a different resistance level from another elastic band. Thus, the design requires a number of elastic bands to provide the variable resistance, in addition to the number of elastic bands needed to provide for various exercise postures. This results in many elastic bands being included within the device compartment, and, along with the weight of the compartment itself, lends to a still relatively bulky exercise apparatus. In addition, although there is variable resistance available to the user by choosing one or a combination of the different elastic bands, the apparatus does not offer any sort of small or incremental adjustment of resistance.

Hence, it is desirable to have a solution, without the above-described disadvantages, such as an exercise apparatus with finely adjustable resistance, versatility of use, and ease of portability. As will be seen, the invention provides such a solution in an elegant manner.

DETAILED DESCRIPTION OF THE INVENTION

The invention is directed to a multi-functional exercise apparatus with adjustable resistance. In particular, the invention is directed to an exercise apparatus with adjustable resistance, the exercise apparatus comprising a column, a spooling device coupled to the column, and an elastic member coupled to the spooling device, wherein movement of the elastic cord is permitted and the spooling device is configured to be rotatably adjustable to limit the movement of the elastic member.

Figure 1A:
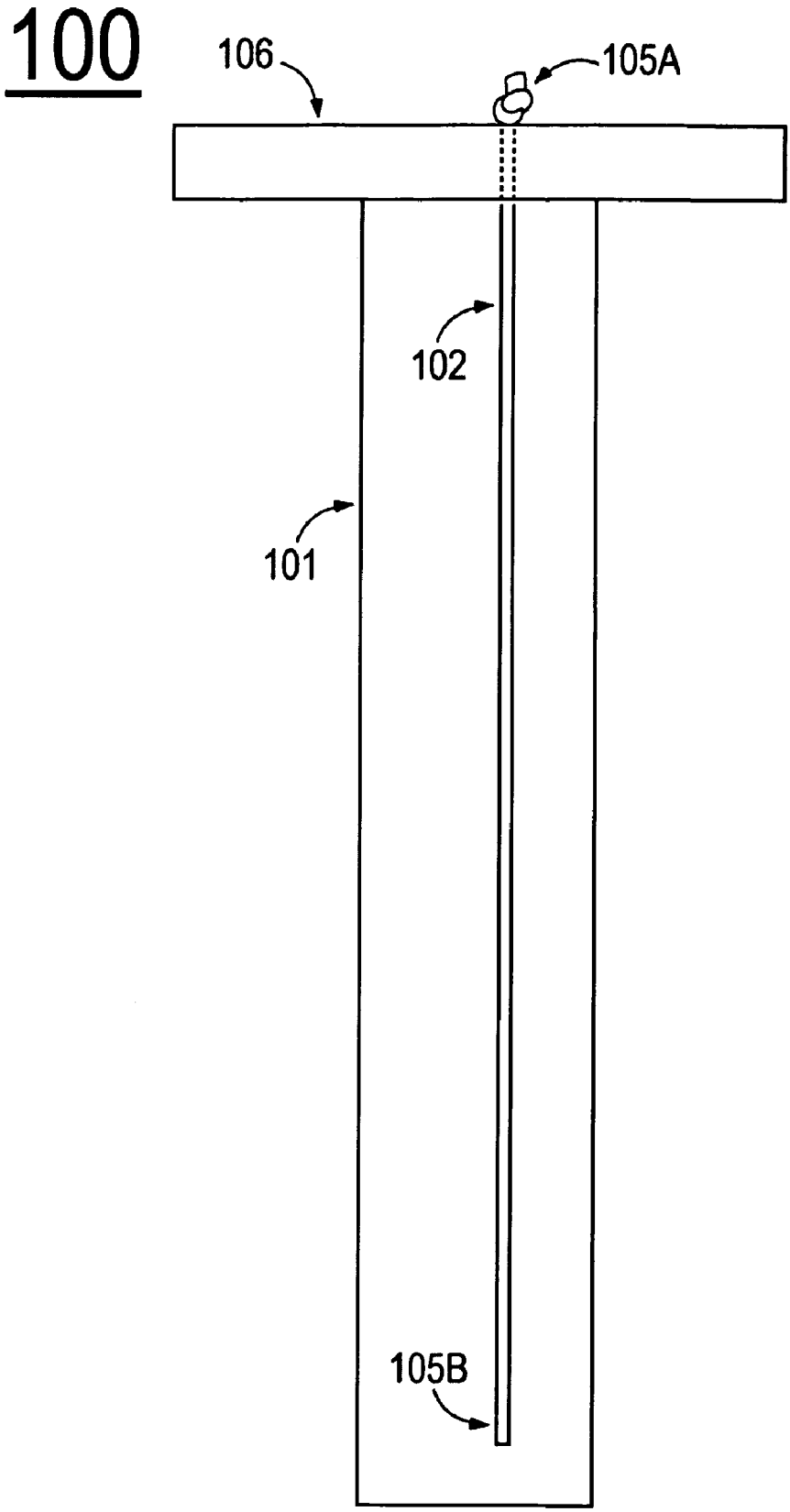
FIGS. 1A-B illustrate an embodiment of an exercise apparatus according to the invention.
Figure 1B:
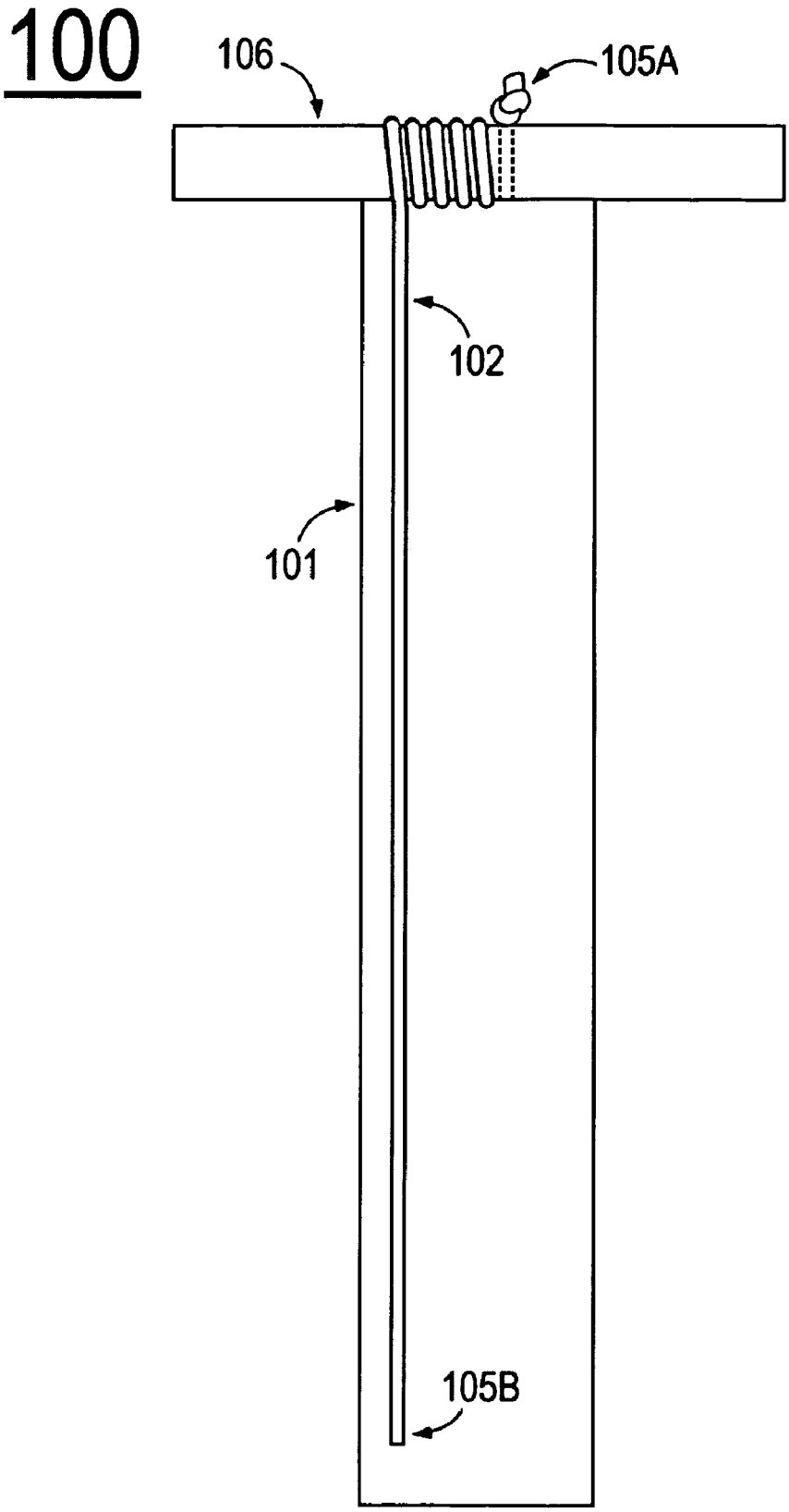

FIG. 1A illustrates an embodiment of an exercise apparatus 100 with adjustable resistance. Exercise apparatus 100 includes a column 101, to which a spooling device 106 may be coupled. Column 101 may be solid, hollow or of another configuration that provides support for the spooling device 106. Elastic member 102 may be coupled to spooling device 106 at end 105A, via, for example, a knot tied at end 105A. Exercise apparatus 100 may be configured so that spooling device 106 is rotatably adjustable to constrict or further the movement of elastic member 102. For example, spooling device 106 may be configured to rotate, thus wrapping elastic member 102 around spooling device 106, starting from end 105A, as illustrated in FIG. 1B. The wrapped state of elastic member 102 in FIG. 1B renders a higher resistance for a user pulling from, for example, the free end 105B of elastic member 102.

This method of resistance adjustment may allow for an incremental increase or decrease of resistance, and may be conducive to use, for example, in physical therapy, by individuals of a smaller frame, by novices in resistance training, or by anyone who simply desires the ability to adjust resistance in closer intervals than those conventionally available. Additionally, the presently disclosed configuration allows for a more compact manufactured product, as it may eliminate the necessity of, for example, combining different elastic members of various resistance levels to achieve a similar effect. However, the exercise apparatus is not limited to incremental adjustment of resistance, and may be used in conjunction with pins, toggles, or other forms of adjustment conventionally known to those skilled in the art.

Figure 2A:
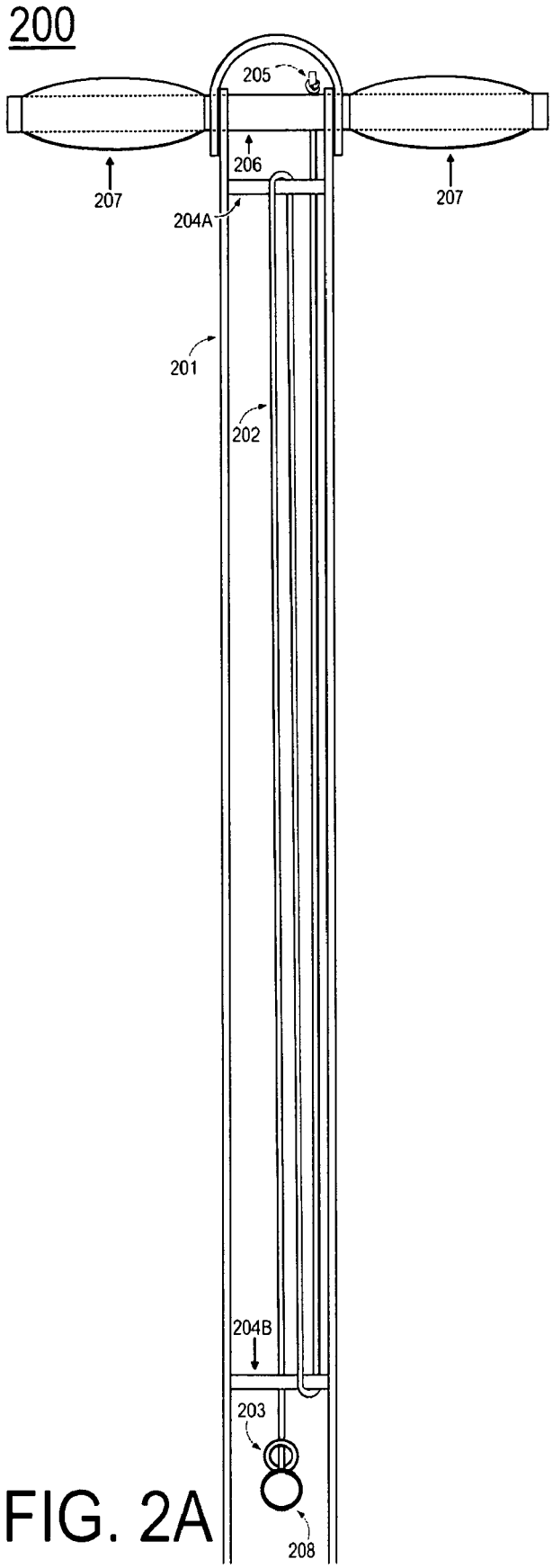
FIGS. 2A-F illustrate another embodiment of an exercise apparatus according to the invention.

FIG. 2A depicts another embodiment of a multi-functional exercise apparatus with adjustable resistance, with the adjustable resistance set at the least resistive, longest range of motion setting. The illustrated exercise apparatus may include a column, shown as housing 201, with an elastic cord 202 mounted in such a way as to facilitate its movement within the housing 201, allowing the elastic cord 202 to expand, contract and ex it an aperture 203 at the base. The elastic cord 202 may be anchored at one end 205 to a spooling device 206 attached to a handle 207. The other end of elastic cord 202 may exit the housing 201 at the base through an aperture 203 and can be attached to the user. The elastic cord 202 may be supported and routed over, under, behind and in front of supportive structures 204A and 204B. In one embodiment a bolt may be used as supportive structures 204A and 204B and passed through an aperture on each side of the housing 201 to support the elastic cord 202 and allow it to slide as the elastic cord 202 is stretched by either the user attached to an attachment member, such as ring 208, or by the rotating spooling mechanism 206 that alters the apparent resting length of the elastic cord 202. Other structures of support could be used, including, but not exclusively, pulleys, stanchions, pegs, bushings or another structural member around which the elastic cord 202 could be mounted and allowed to slide freely. As shown in FIG. 2A, the elastic cord 202 may be attached to the spooling device by a knot tied in the end 205 of the elastic cord 202 to keep it from passing through an aperture in the spooling device 206 which the elastic cord 202 is passed through. The elastic cord 202 may pass out of the bottom of the spooling device 206 and proceed down ward behind the supportive structure 204A, and continue downward, passing behind, under and coming upward in front of supportive structure 204B, continuing upward, passing behind, over and in front of supportive structure 204A and continuing downward until it passes behind supportive structure 204B and exits the housing 201 through an aperture 203 at the base of the housing 201. It should be noted that the elastic cord 202 may be any type of elastic cord or other flexible material having elastic properties. Some exemplary materials include bungee cord, flexible rubber, tubing, or other types of elastic, flexible, or stretchy cords.

Figure 2B:
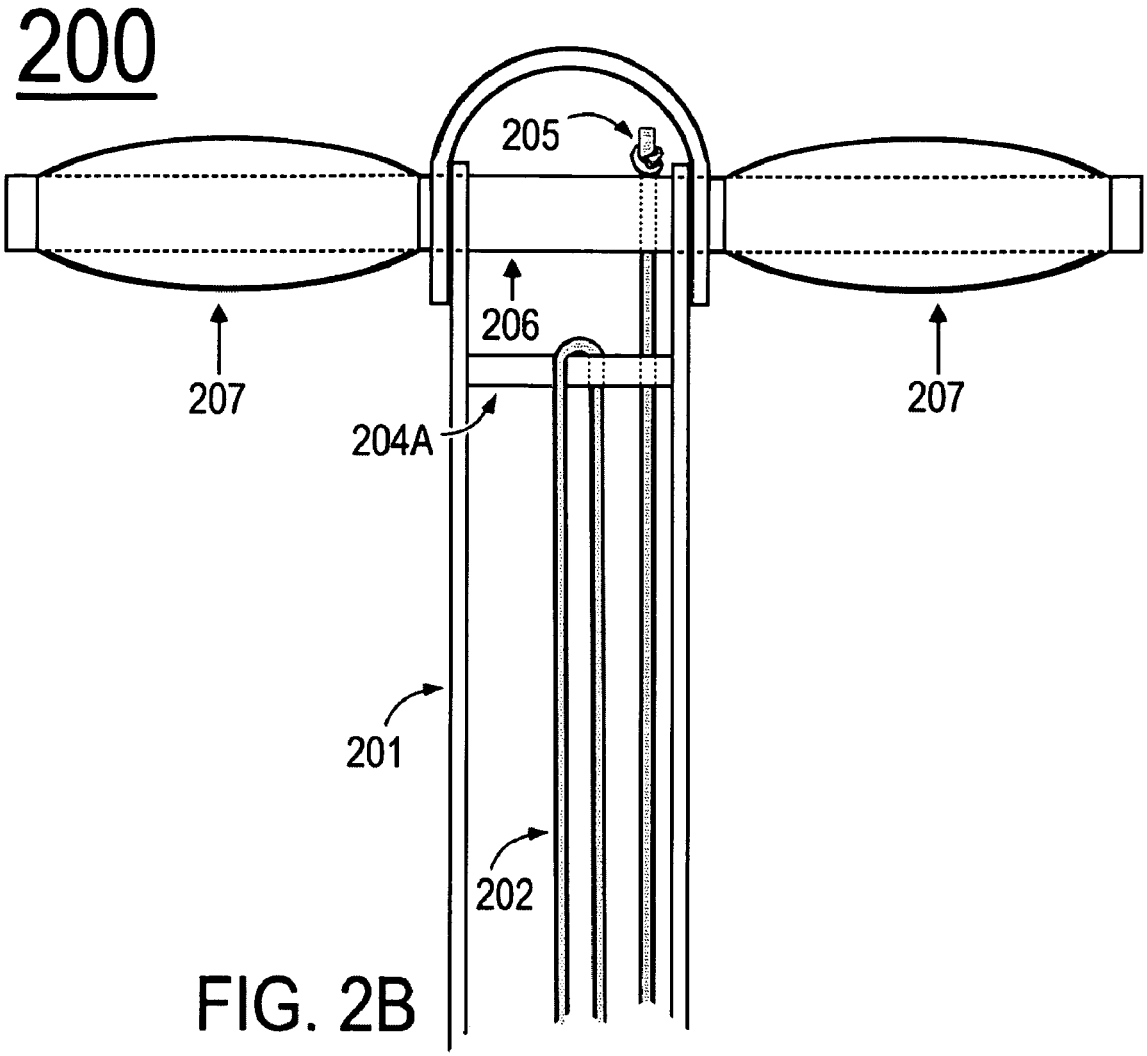

FIG. 2B depicts a schematic diagram of the upper portion of the embodiment in FIG. 2A, allowing for a more detailed vie wing of the handle 207, spooling device 206, attachment at end 205 of the elastic cord 202 to the spooling device 206, and configuration of the elastic cord 202 in the area of the supportive structure 204A.

Figure 2C:
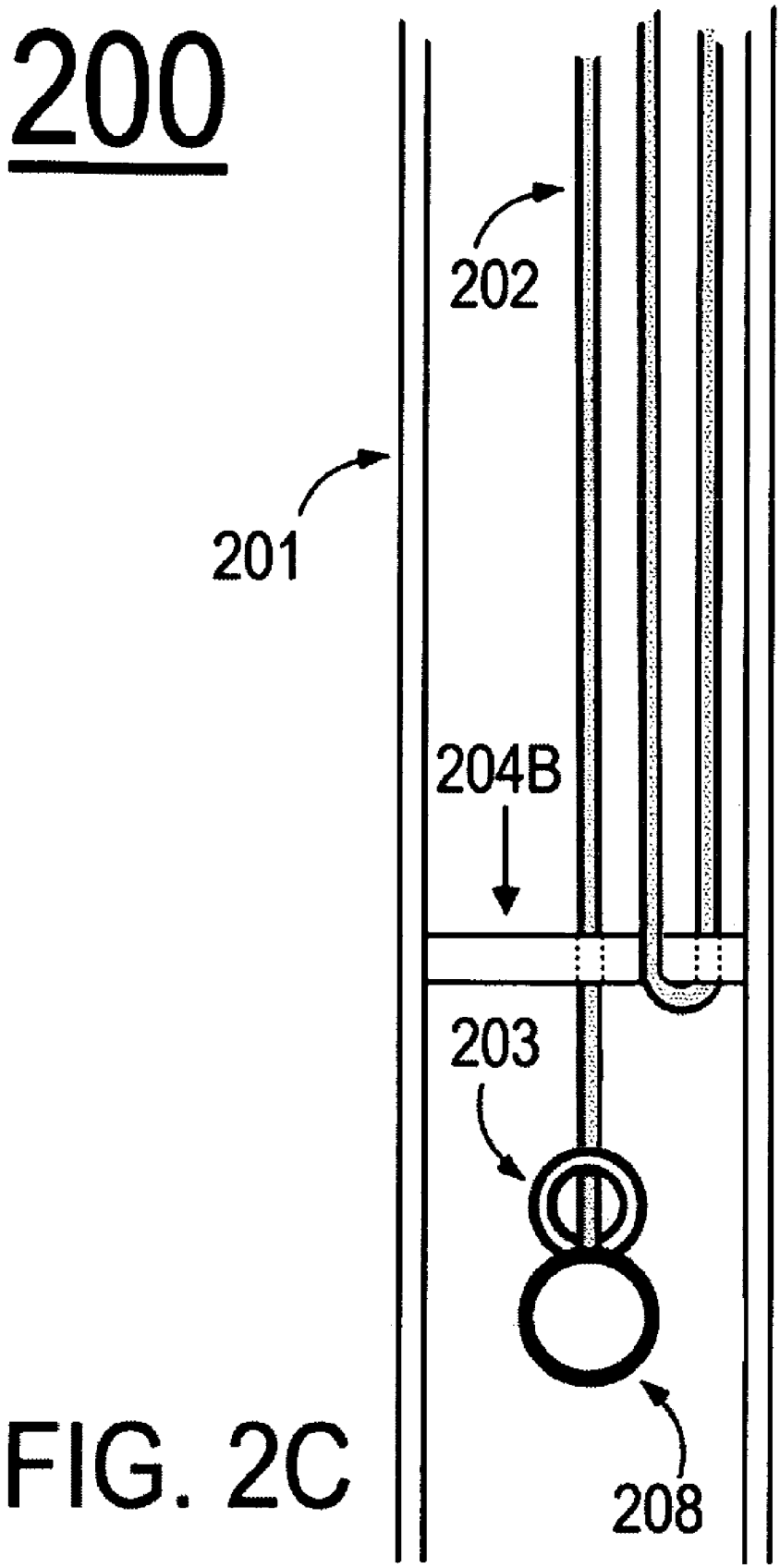

FIG. 2C depicts a schematic diagram of the lower portion of the embodiment in FIG. 2A, allowing for a more detailed viewing of the configuration of the elastic cord 202 in the area of the supportive structure 204B, aperture 203 and ring 208.

Figure 2D:
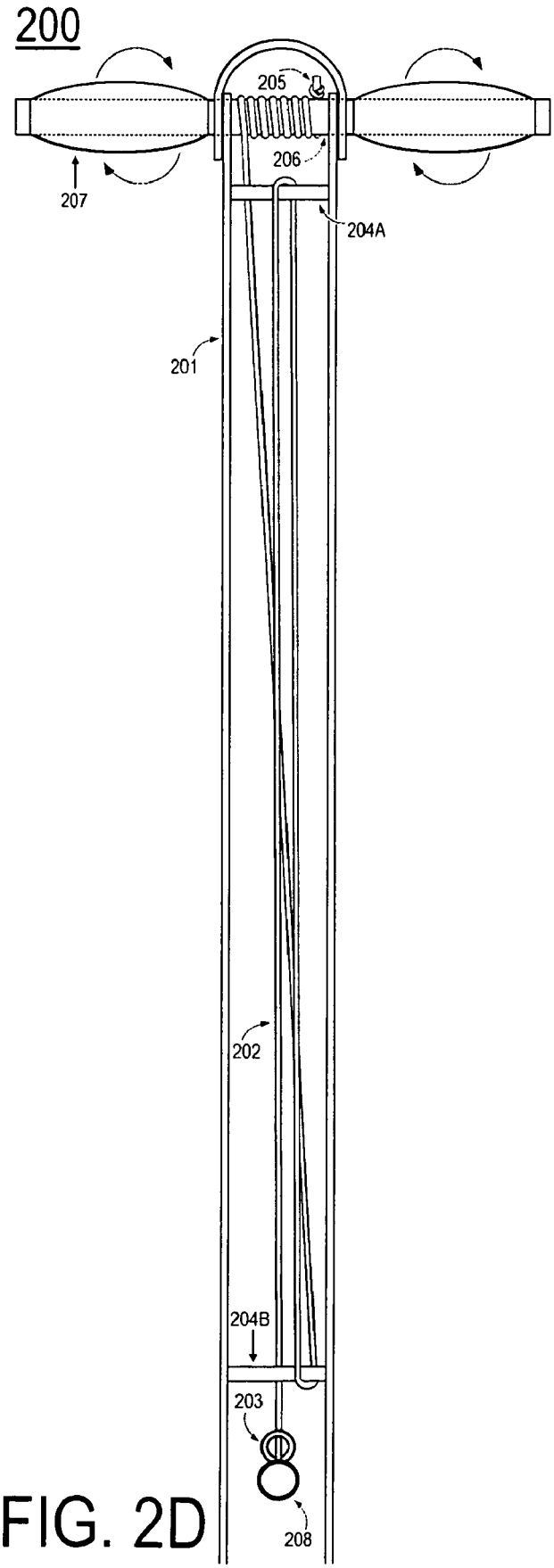

FIG. 2D depicts a schematic diagram of the embodiment of the multi-functional exercise apparatus in FIG. 2A with the adjustable resistance set at the most resistive, shortest range of motion setting. In FIG. 2D, the handle 207 has been rotated in a direction away from the user to facilitate the movement of the spooling device 206 in a rotational manner that would cause the elastic cord 202 to be wound around the spooling device 206 for a number of turns, effectively shortening the apparent resting length of the elastic cord 202.

Figure 2E:
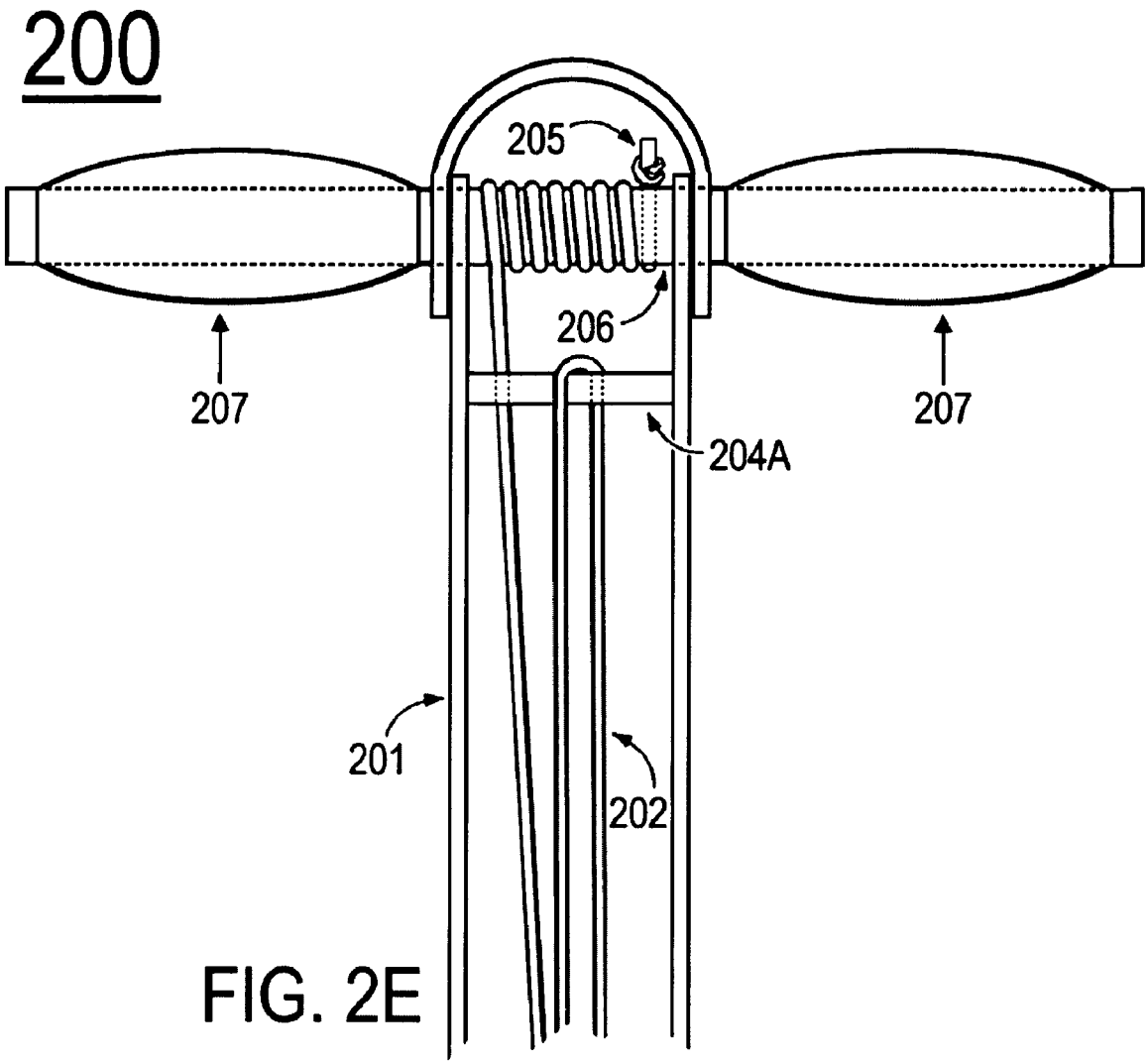

FIG. 2E depicts a schematic diagram of the upper portion of the embodiment in FIG. 2D, allowing for a more detailed vie wing of the handle 207, spooling device 206, attachment at end 205 of the elastic cord 202 to the spooling device 206 and configuration of the elastic cord 202 in the area of the supportive structure 204 A.

Figure 2F:
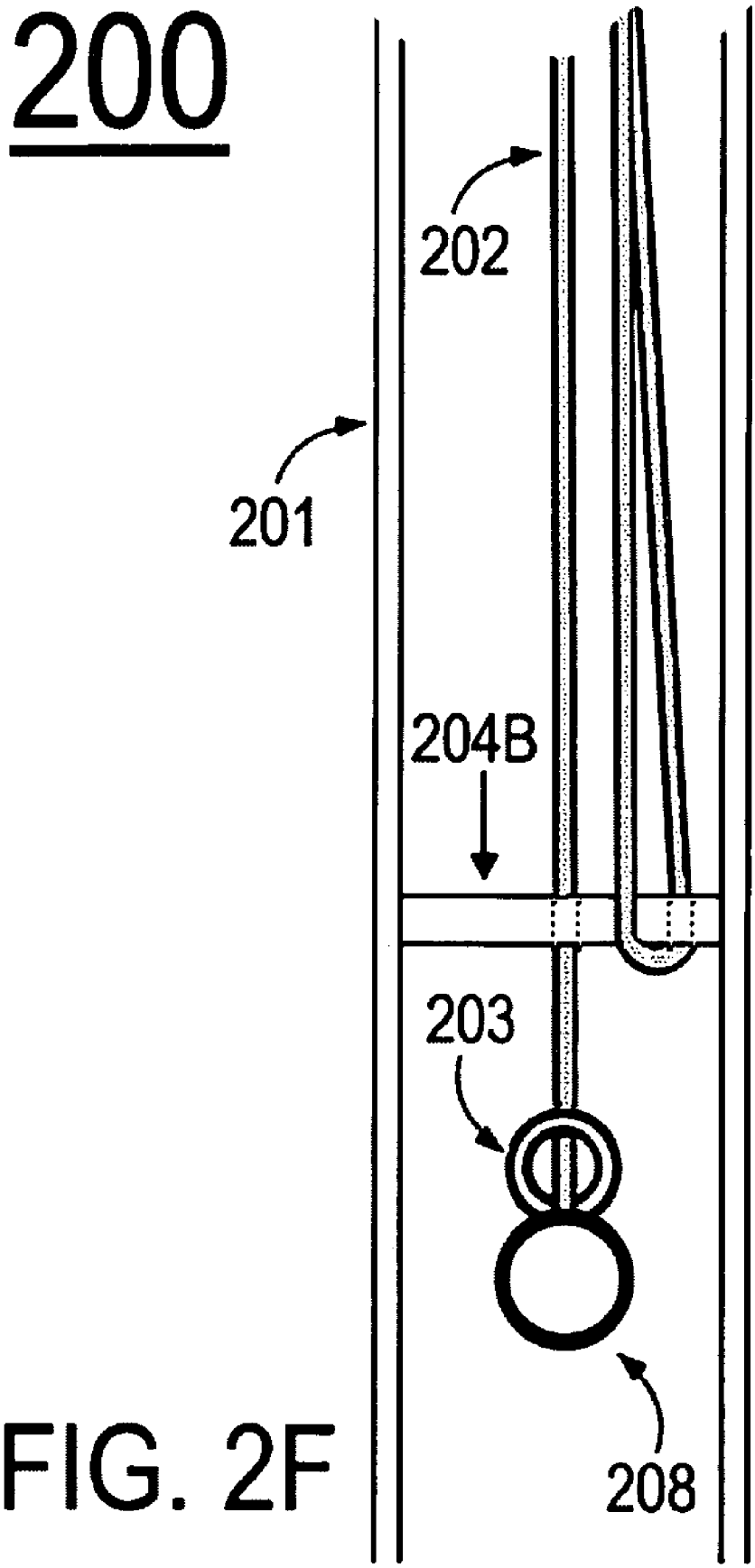

FIG. 2F depicts a schematic diagram of the lower portion of the embodiment in FIG. 2D, allowing for a more detailed vie wing of the configuration of the elastic cord 202 in the area of the supportive structure 204 B, aperture 203 and attachment ring 208.

Figure 11:
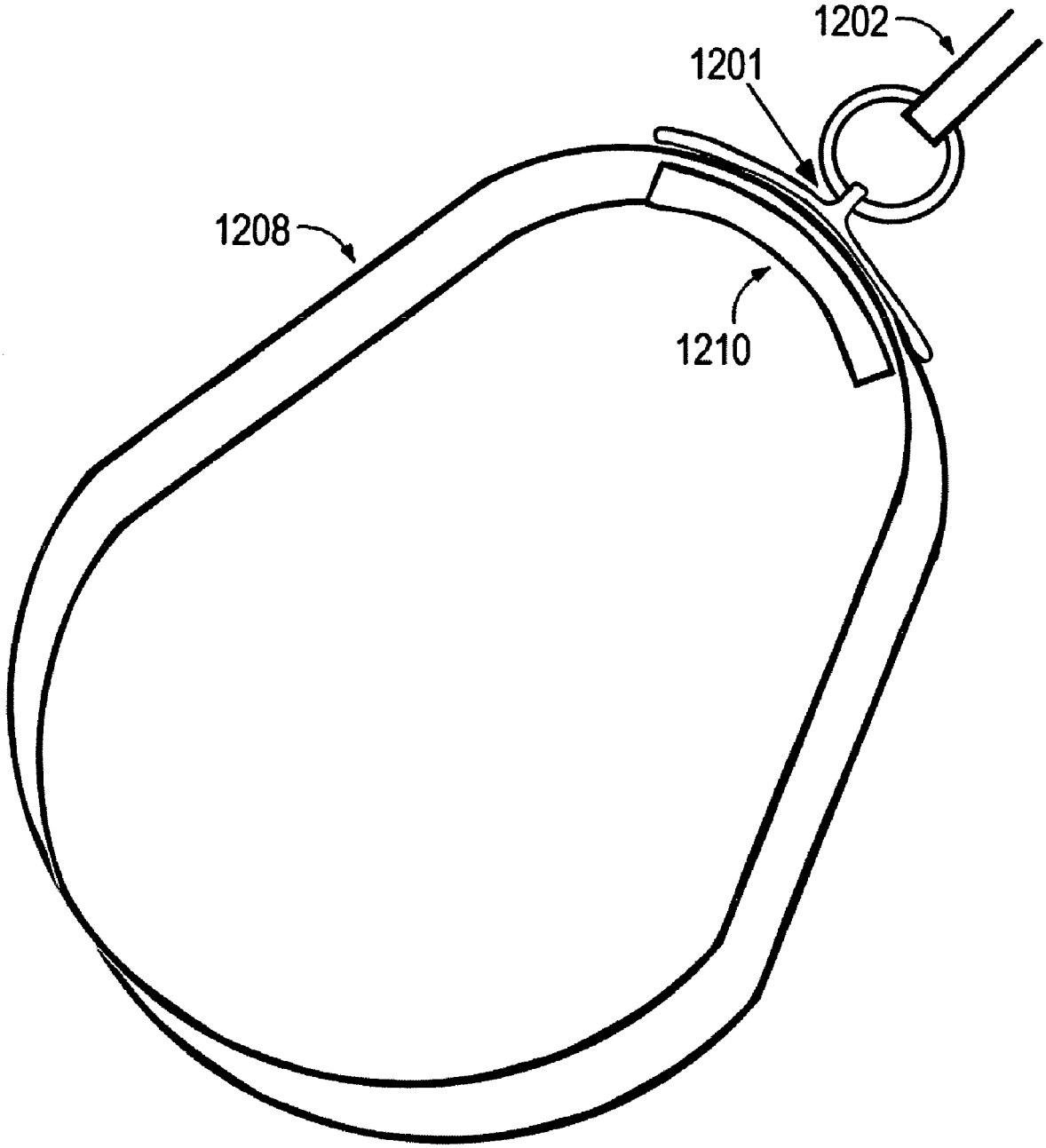
FIG. 11 illustrates an embodiment of an attachment member according to the invention.

It should be noted although the attachment member illustrated is in the form of a ring 208, other forms of attachment, such as a clasp, adjustable cuff, handle, bar or other suitable device, may be used. If a ring is used, it may be constructed of one or more of various materials. Optionally, as shown in FIG. 11, the ring 1208 may include a tube 1210, or other appropriate member, coupled to the ring 1208 along the material of the ring 1208, wherein a cord 1202 may be coupled to the ring at a point 1201 at or about the middle, or other portion, of tube 1210. This configuration allows the ring 1208 to stay in a relatively open position, for the convenience of a user switching between exercises.

The rotation of the adjustable resistance handle 207 is free-flowing. It should be noted that a mechanism may optionally be installed to allow the adjustable handle 207 to be turned but not allowed to travel in the opposite direction when the user releases pressure on the rotating handle 207. The mechanism could then be released intentionally by the user to allow the rotating handle 207, and subsequently the spooling device 206, to return to its resting state, the state of least or lesser resistance. The mechanism could also have a positional option to allow it to be constantly disengaged, so as to facilitate the free-flowing action.

As elastic cord 202 is stretched in a longitudinal direction (i.e., along the length of the cord) by the user, resistance increases The further the elastic cord is stretched relative to its resting state, the more resistance encountered. If the resting length of the elastic cord is altered (i.e., lengthened or shortened) less stretching of the elastic cord may be needed to encounter an increased resistance, or a greater resistance may be encountered with the same amount of stretching. As the handle 207 is rotated in either a clockwise or counterclockwise direction, it may serve to wind up the elastic cord, thereby the length of the cord is effectively decreased. Therefore, by rotating the handle 207 and adjusting the effective length of the elastic cord, the resistance of the cord can be altered, given the same given range of motion or stretch created by the user, consequently adjusting the resistance according to a user's preference. The resistance of the cord can be altered to unlimited approximate resistance values. As one example, a user may rotate handle 207 the maximum number of turns allowed by the spooling device capacity or by a stop member attached to the spooling end of the elastic cord. This configuration provides the most resistance for the user, for example, when the user attaches a handle to the attachment ring 208 located where the cord exits the housing 201 through an aperture 203 and the user pulls on the handle effectively stretching the resting length of the elastic cord. For a less strenuous workout, the user may decrease the resistance of the exercise apparatus by adjusting the position of the rotating handle to allow the elastic cord to return to its resting length. In other words, as the handle is rotated and the elastic cord is wound up on the spool, the effect is to shorten the length of the elastic cord from the point of first contact with the spool to the aperture where the cord exits the housing and the resistance of the cord increases even though the user stretches the cord to the same length relative to the aperture where the cord exits the housing as it was stretched prior to the cord length being affected by the winding of the cordon the spooling device. This technique can be employed in other embodiments as well.

It should be noted that pre-tensioning of elastic cord 203 may be desirable to retain the attachment member 208 located at the base of the unit snugly against the housing of the exercise apparatus while it is not in use, and to keep the attachment member 208 more readily available to the user.

Embodiments of the exercise device may be made of metal, plastic, or another suitable type of material. Other embodiments of the exercise apparatus may implement other types of adjustable spools or length reducing mechanisms.

It should be noted that other embodiments may use another type of exit from the housing of the exercise apparatus in place of or addition to the fixed aperture, such as a pulley.

Additionally, the pulley may be fixed or movable, depending on the implementation of the exercise apparatus.

It should be noted that one motivation for using multiple passes of cord within the housing would be to allow further distance to be traveled outside of the housing, thus allowing the user a larger range of motion. Such a configuration may also allow for a larger variation in resistance, as the longer the cord, the less resistance required to stretch it a given distance than the resistance required to stretch a shorter length the same given distance. Thus the more cord available to a user, the more the user can shorten or lengthen the cord and still maintain an adequate range of motion.

Figure 3A:
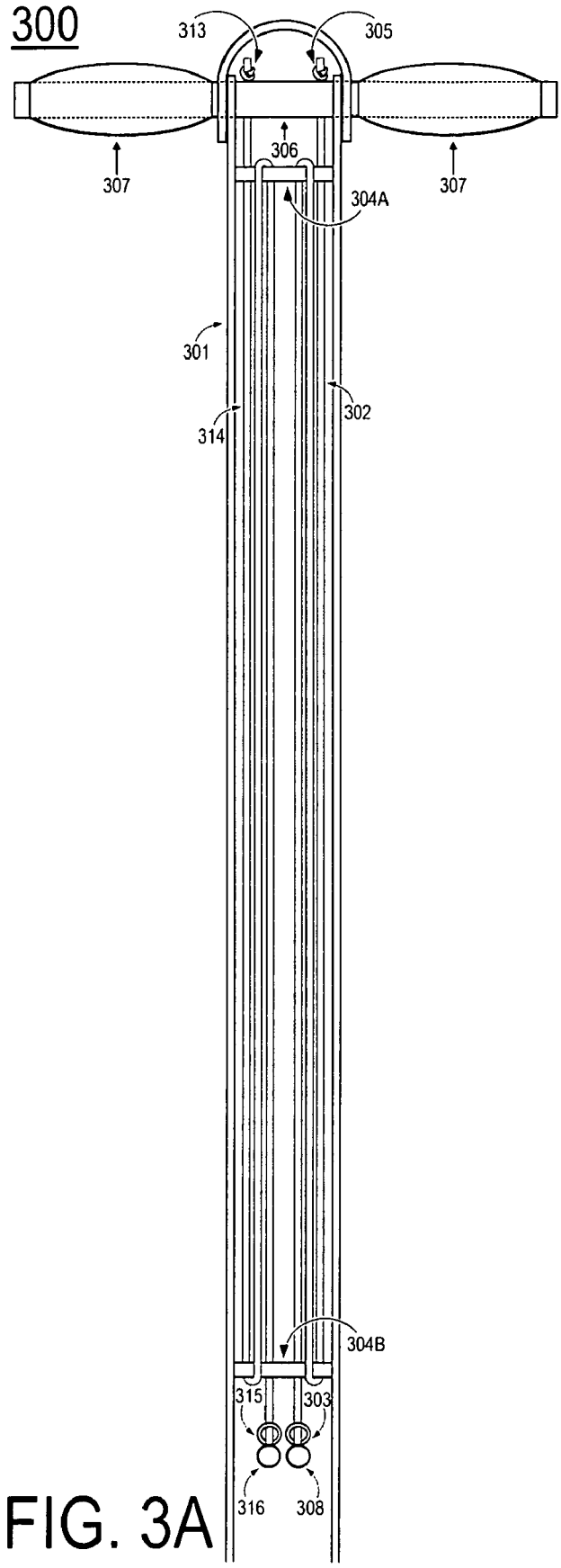
FIGS. 3A-C illustrate another embodiment of an exercise apparatus according to the invention.

FIG. 3A depicts a schematic diagram of one embodiment of a multi-functional exercise apparatus with adjustable resistance, with the resistance provided by two elastic cords. One elastic cord 302 may be attached at end 305 to the spooling device 306. The other elastic cord 314 may also be attached at end 313 to the spooling device 306. The adjustable resistance shown in FIG. 3A is set at the least resistive, longest range of motion setting. One elastic cord 302 may exit the housing 301 through an aperture 303 and may be attached to a ring 308 that allows for attachment to the user. The other elastic cord 314 may exit the housing 301 through another aperture 315 and may be attached to a ring 316 that allows for attachment to the user.

Figure 3B:
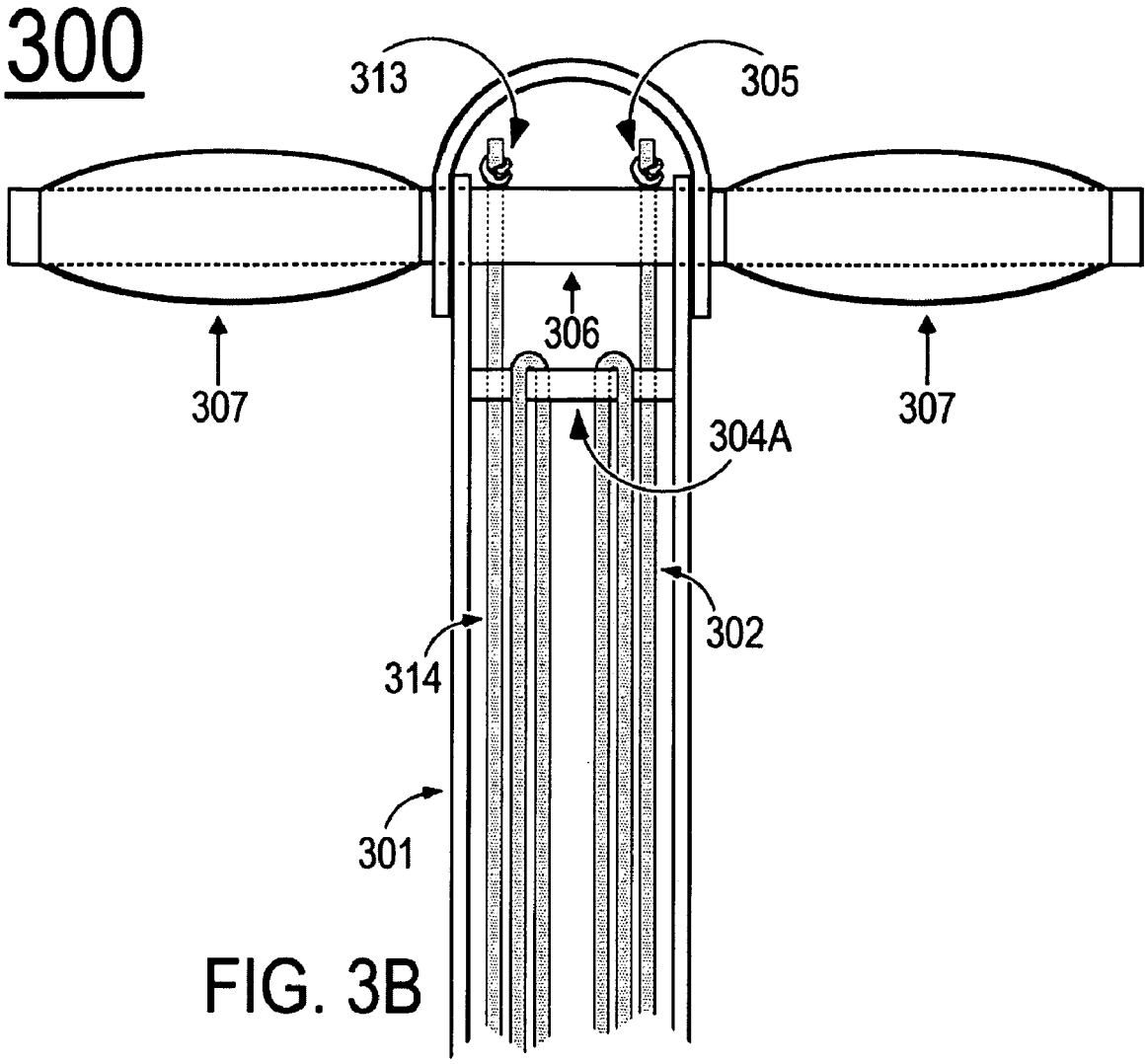

FIG. 3B depicts a schematic diagram of the upper portion of the embodiment in FIG. 3A, allowing for a more detailed viewing of the handle 307, spooling device 306, attachments at ends 305 and 313 of the elastic cords 302 and 314 to the spooling device 306 and configuration of the elastic cords 302 and 314 in the area of the supportive structure 304A.

Figure 3C:
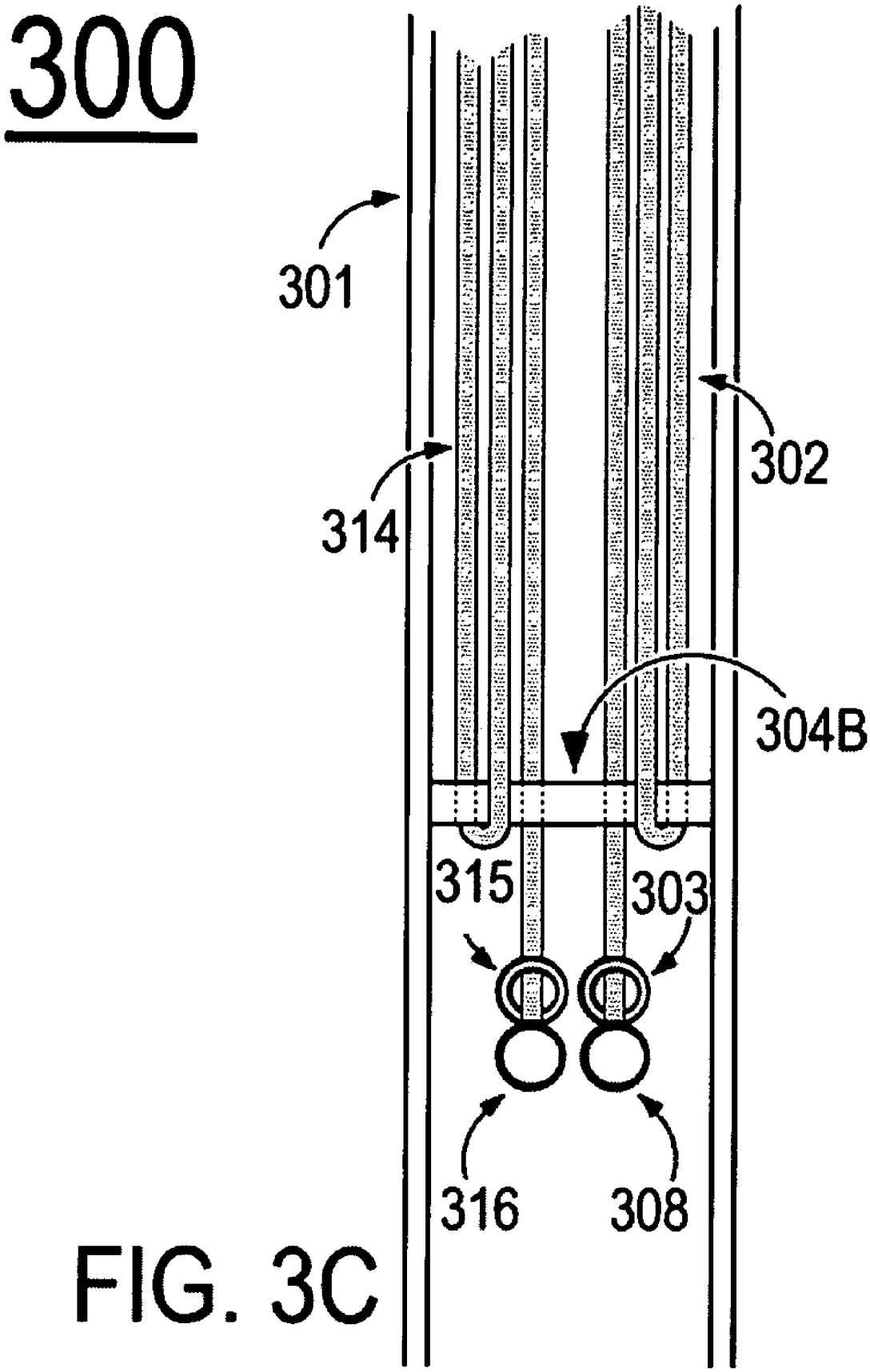

FIG. 3C depicts a schematic diagram of the lower portion of the embodiment in FIG. 3A, allowing for a more detailed viewing of the configuration of the elastic cords 302 and 314 in the area of the supportive structure 304B, apertures 303 and 315 and attachment rings 308 and 316.

It should be noted that exercise apparatus 300 could also be constructed with only one aperture 303. In such construction, both elastic cords 302 and 314 could be configured to exit the housing 301 through one aperture 303 and remain attached to independent attachment rings 308 and 3016 or be attached to a single attachment ring 308. In such configuration where elastic cords 302 and 314 exit the housing 301 through one aperture 303 or two apertures 303 and 315 and remain independent of each other by attaching to separate and independent attachment rings 308 and 316, a wider variety of resistance combinations are made available, since either one cord or two cords may be attached to the user. Cords of identical elastic qualities could be utilized or cords of unequal elastic qualities could be utilized to even further the disparities of resistive values between single or multiple attachment of cords to the user at any given rotated posit ion of the spooling device 306.

In the cord configuration of exercise apparatus 300, multiple cords may be attached and routed throughout the exercise apparatus housing and allowed to exit one or more apertures in the housing to provide an even greater range of resistance by allowing the user to attach one or a plurality of elastic cords to the user. For example, if two cords are used, one cord can be attached to the user and provide the resistance allotted by that particular cord. By attaching the additional cord, the resistance could in effect be doubled. Then the user can further alter the resistance by rotating the adjustment handle.

In addition, each side of the adjusting handle 307 could be constructed independently of one another, and each adjusting handle 307 attached to a separate spooling device 306 so that the handle 307 on the left side of the multi-functional exercise apparatus and its specific spooling device 306 could be rotated away from the user or towards the user or left stationary regardless of the direction of rotation or lack of rotation applied by the user to the adjustment handle 307 and its specific spooling device on the right side of the multi-functional exercise apparatus The result of this configuration would enable the user to effectively alter the resting length of the elastic cord 314 on the left side of the housing 301 and the effective resting length of the elastic cord 302 on the right side of the housing 301 independent of each other. For example, the user could rotate the handle 307 on the left side of the multi-functional exercise apparatus causing its specific spooling device 306 to rotate and alter the effective resting length of the elastic cord 314 on the left side of the housing 301 while leaving the handle 307 on the right side of the multi-functional exercise apparatus and its specific spooling device 306 in its current position, leaving the effective resting length of the elastic cord 302 on the right side of the housing 301 unaltered. Non-rotation or rotation away from or towards the user of one handle 307 and its specific spooling device 306 shall not affect or be effected by the other handle and its specific spooling device not being rotated or being rotated away from or towards the user.

Figure 4A:
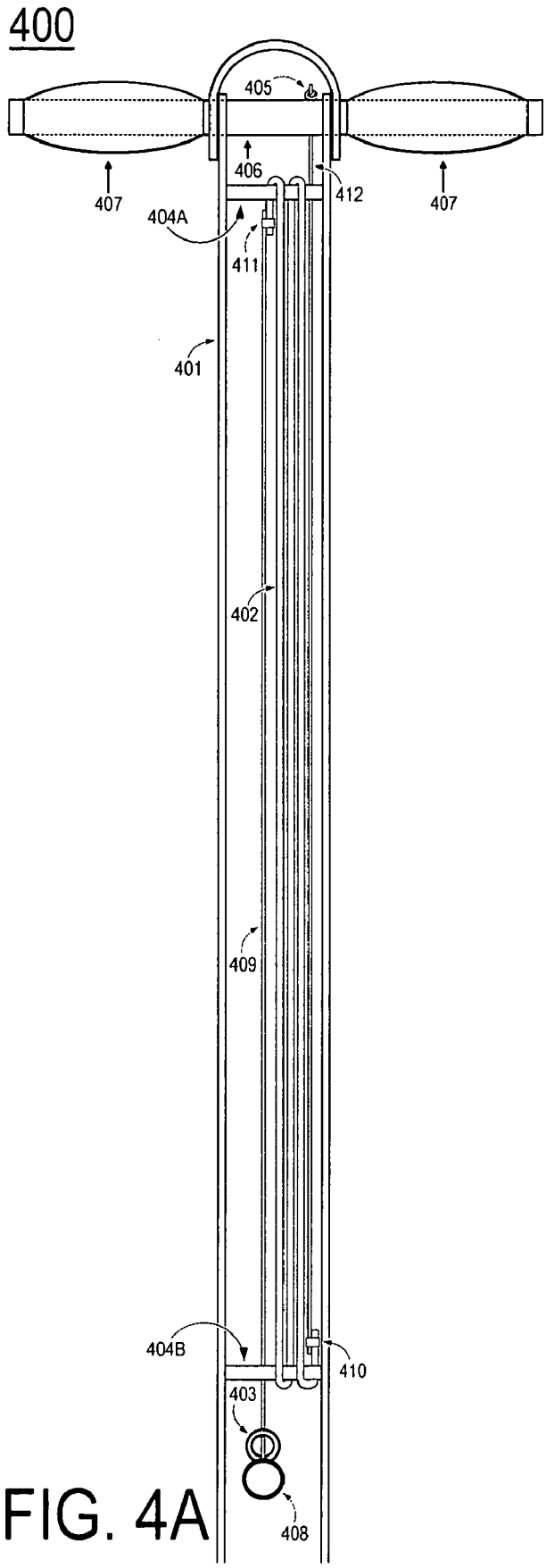
FIGS. 4A-C illustrate another embodiment of an exercise apparatus according to the invention.

FIG. 4A depicts a schematic diagram of one embodiment of a multi-functional exercise apparatus with adjustable resistance with a single elastic cord 402 providing resistance and two non-elastic cords 409 and 412 providing attachment. One non-elastic cord 412 may be attached via attachment 410 to one end of the elastic cord 402 and may be attached at end 405 of the elastic cord 402 to a spooling device 406. The other non-elastic cord 409 may attach via attachment 411 to the other end of the elastic cord 402 and ex it the housing 401 of the apparatus through an aperture 403 at the base of the unit allowing for attachment to the user with a ring 408. The resistance shown is set in the least resistance configuration.

Figure 4B:
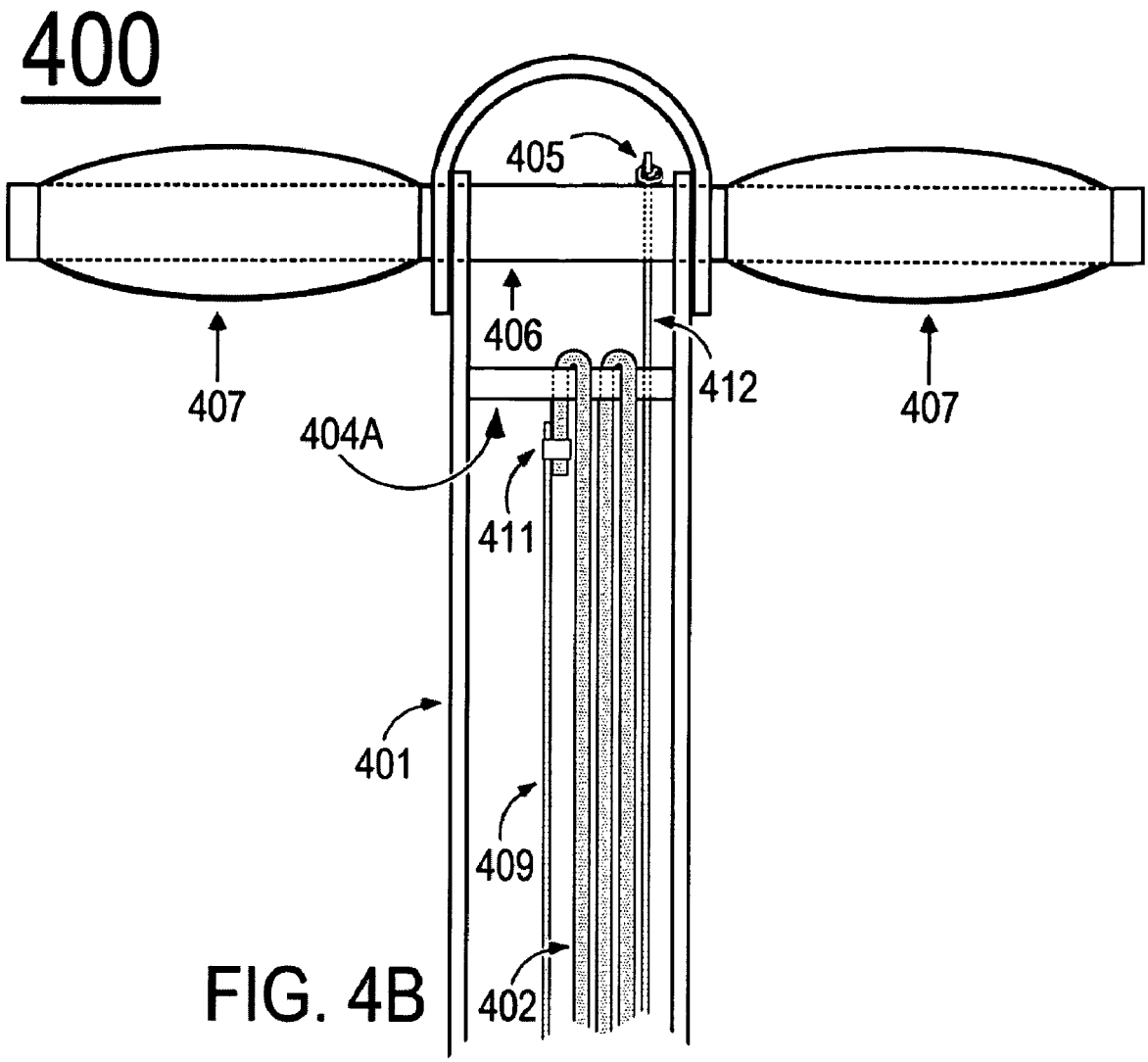

FIG. 4B depicts a schematic diagram of the upper portion of the embodiment in FIG. 4A, allowing for a more detailed vie wing of the handle 407, spooling device 406, attachment at end 405 of one non-elastic cord 412 to the spooling device 406, attachment 411 of the other non-elastic cord 409 to the end of the elastic cord 402 and configuration of the elastic cord 402 in the area of the supportive structure 404A.

Figure 4C:
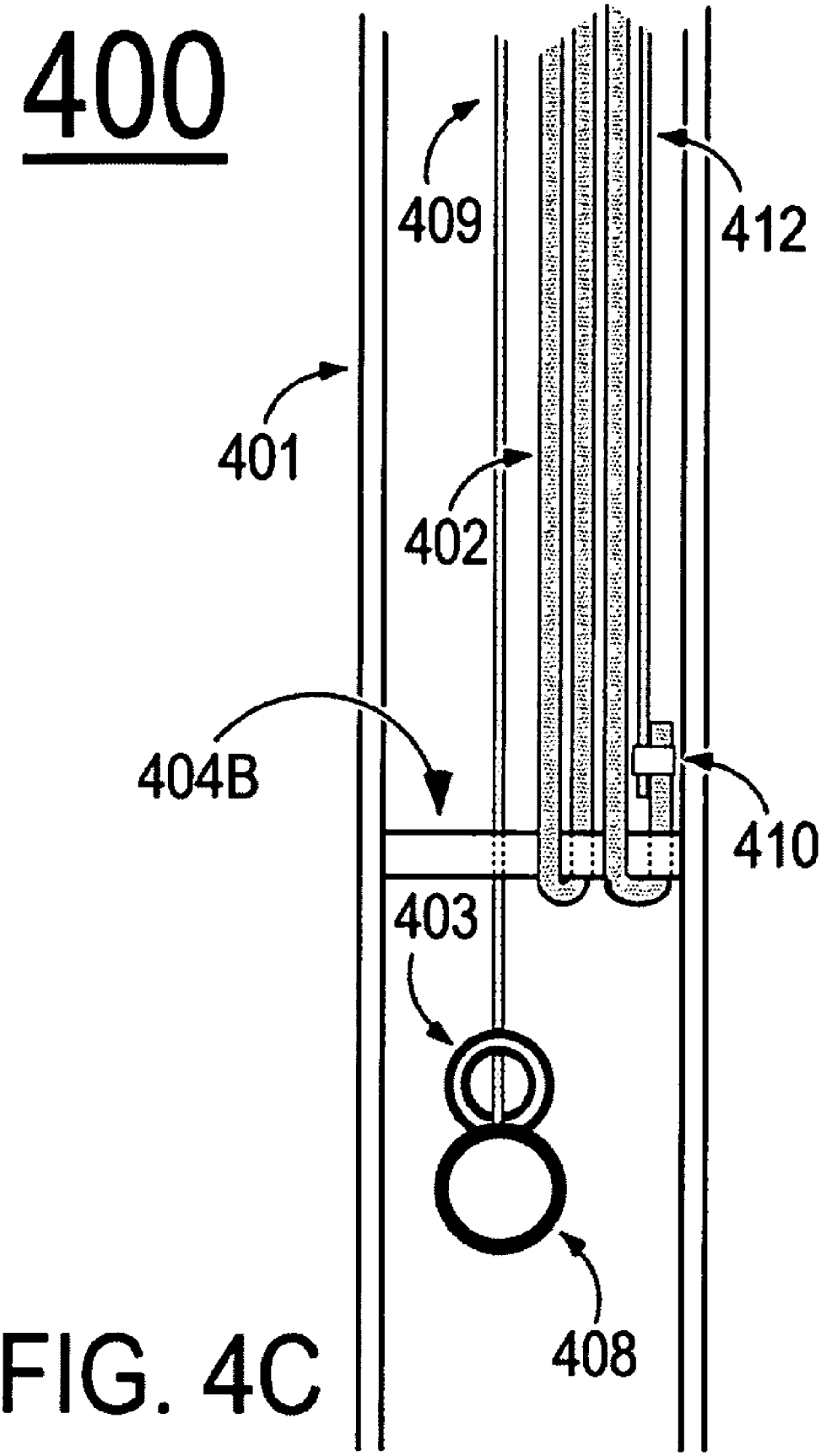

FIG. 4C depicts a schematic diagram of the lower portion of the embodiment in FIG. 4A, allowing for a more detailed viewing of the configuration of the elastic cord 402, non-elastic cords 412 and 409 and attachment 410 of the elastic cord 402 to the non-elastic cord 412, in the area of the supportive structure 404B, aperture 403 and attachment ring 408.

It should be noted that the cord configuration of exercise apparatus 400 may allow the elastic cord 402 to remain within the housing 401 and the extension of travel outside the housing 401 to be facilitated by a cord, cable or other non-elastic material 409. Allowable travel of the elastic cord 402 could be limited to within the housing 401 by calculating and limiting the in stalled resting length of elastic cord 402 so that when its maximum stretch ratio is reached there is not sufficient length for it to travel the distance necessary to exit the aperture 403 in the housing 401. Another method would be to utilize a stopping device placed on the non-elastic cord 409 or on the attachment 411 of the non-elastic cord 409 to the elastic cord 402 to stop the elastic cord 402 from exiting the housing 401 through the aperture 403. The stop member may be made of any type of suitable material such as metal or plastic.

Further, the cord configuration may be configured so as to prevent the elastic cord 402 and/or non-elastic cords 409 and 412 from traveling over or past the supportive structures 404A or 404B, such as a pulley, stanchion, bushing or other device. Otherwise, the movement of the cord attachment around such cord mounting devices may create noise, vibration, or possibly deter the movement of the cord assembly. In the elastic-cord only configuration this issue may be avoided, as there is no cord attachment located within the housing, so the cord is of continuous construction from the spooling device to the point after the cord ex its the housing at the aperture at the base of the device.

Figure 5A:
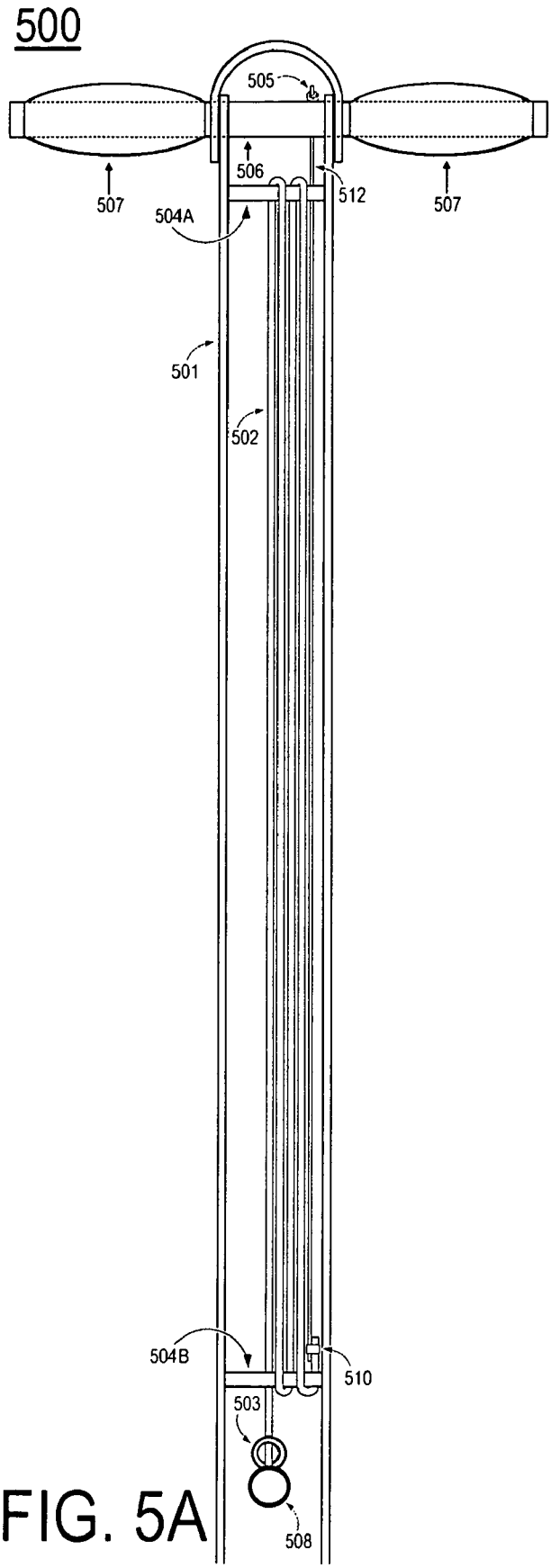
FIGS. 5A-C illustrate another embodiment of an exercise apparatus according to the invention.

FIG. 5A depicts a schematic diagram of one embodiment of a multi-functional exercise apparatus with adjustable resistance with a single elastic cord 502 providing resistance and one non-elastic cord 512 providing attachment at end 505 to the spooling device 506. A non-elastic cord 512 may be attached via attachment 510 to one end of the elastic cord 502 and may be attached at end 505 of the elastic cord 502 to a spooling device 506. The other end of the elastic cord 502 may exit the housing 501 of the apparatus through an aperture 503 at the base of the unit allowing for attachment to the user with a ring 508. The resistance shown is set in the least resistance configuration.

Figure 5B:
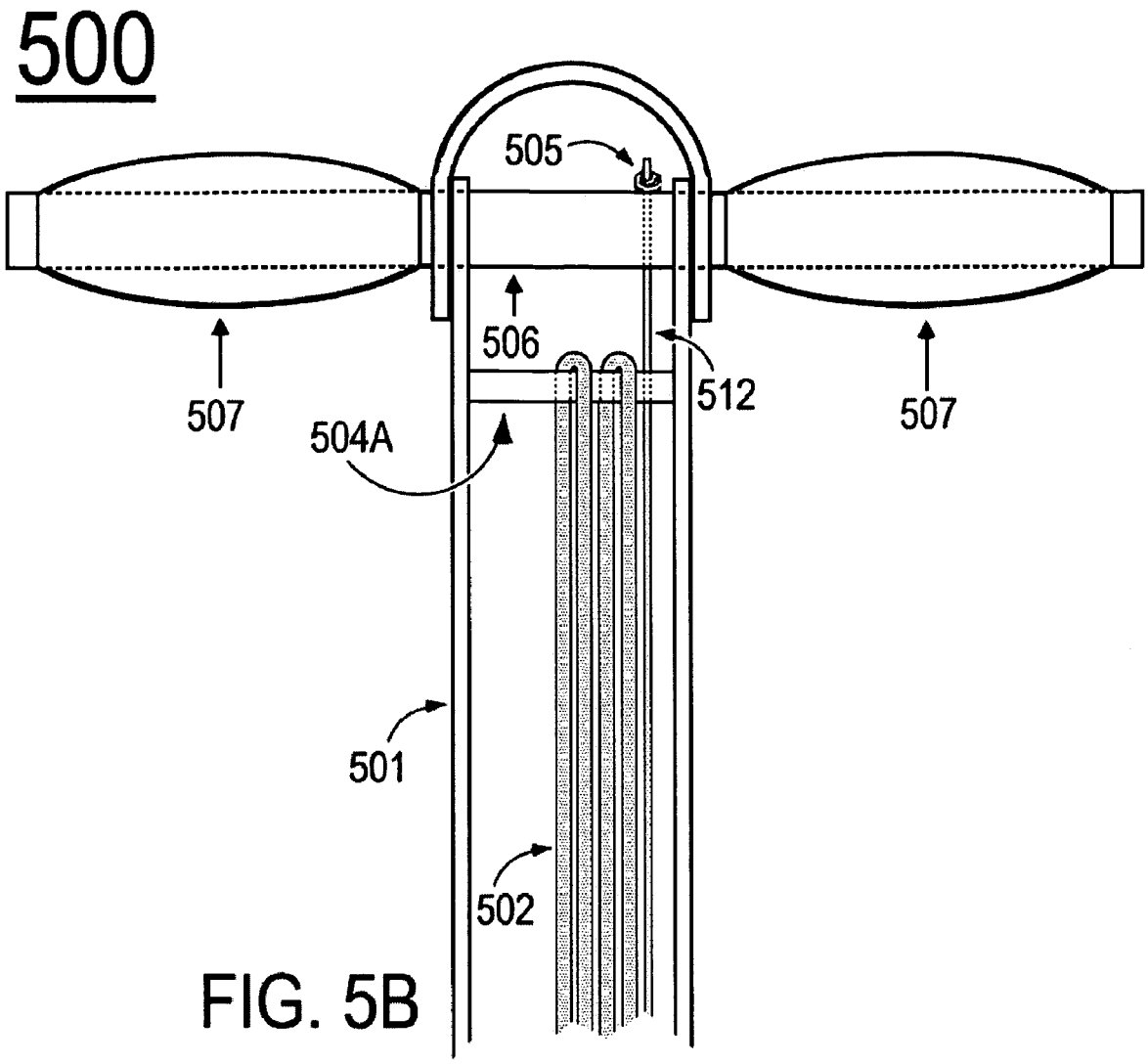

FIG. 5B depicts a schematic diagram of the upper portion of the embodiment in FIG. 5A, allowing for a more detailed viewing of the handle 507, spooling device 506, attachment at end 505 of the non-elastic cord 512 to the spooling device 506, and configuration of the elastic cord 502 in the area of the supportive structure 504A.

Figure 5C:
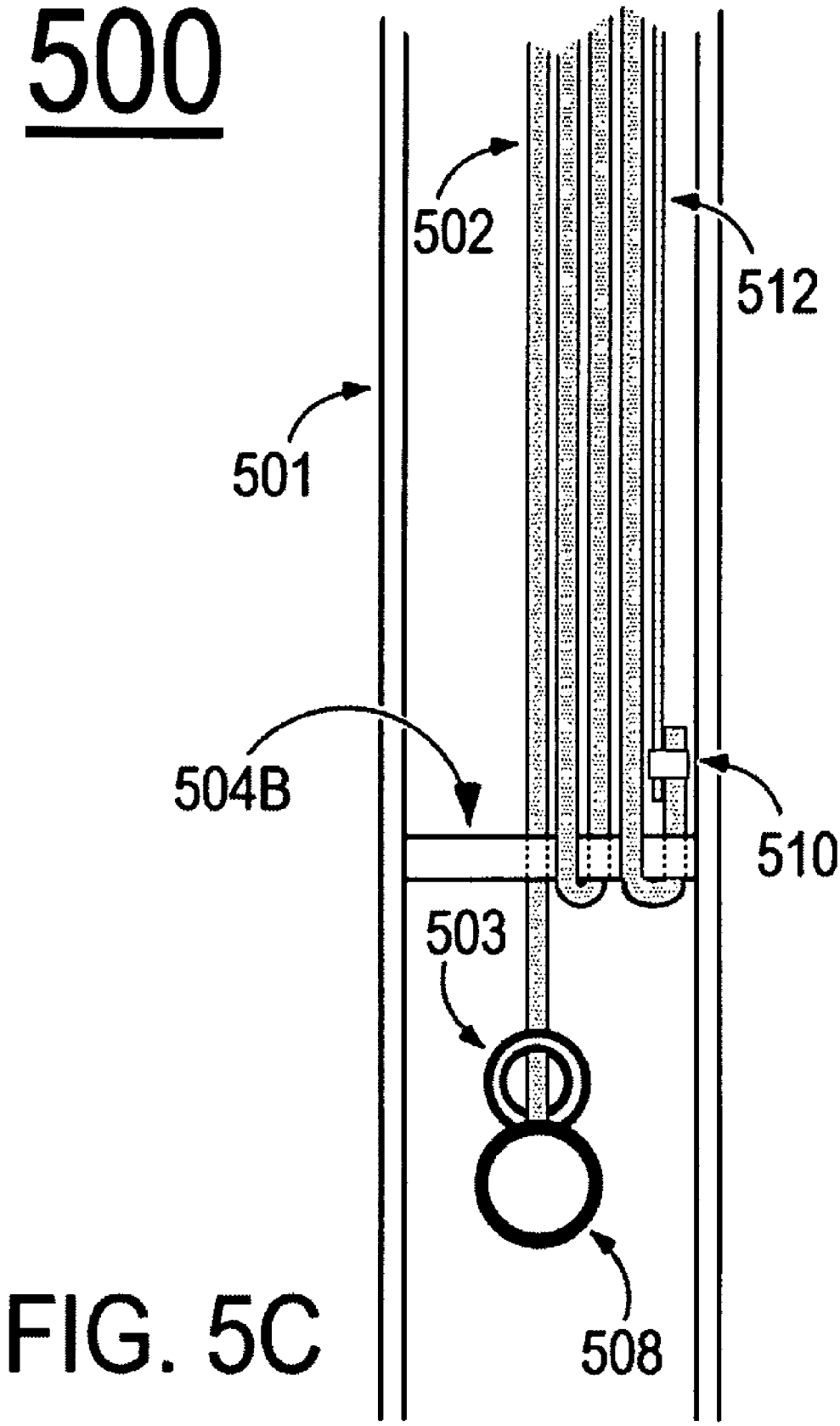

FIG. 5C depicts a schematic diagram of the lower portion of the embodiment in FIG. 5A, allowing for a more detailed viewing of the configuration of the elastic cord 502, non-elastic cord 512 and attachment 510 of the elastic cord 502 to the non-elastic cord 512, in the area of the supportive structure 504B, aperture 503 and attachment ring 508.

Figure 6A:
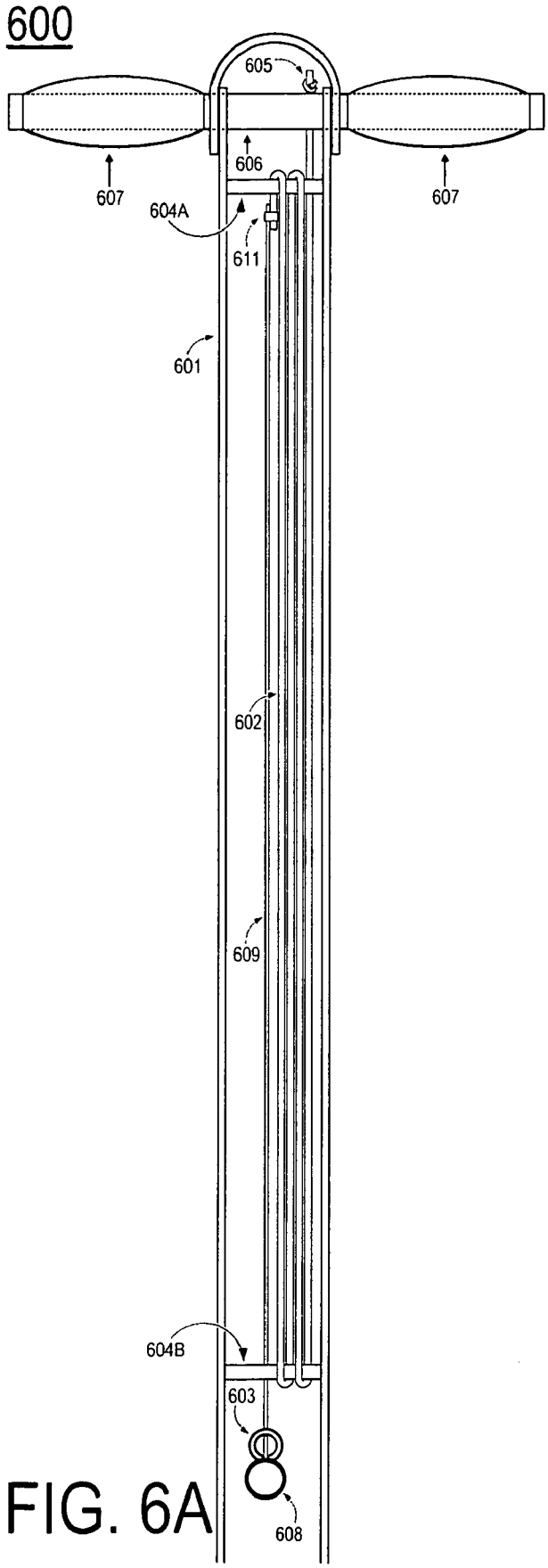
FIGS. 6A-C illustrate another embodiment of an exercise apparatus according to the invention.

FIG. 6A depicts a schematic diagram of one embodiment of a multi-functional exercise apparatus with adjustable resistance with a single elastic cord 602 providing resistance and a non-elastic cord 609 providing attachment. The non-elastic cord 609 may attach via attachment 611 to one end of the elastic cord 602 and exit the housing 601 of the apparatus through an aperture 603 at the base of the unit allowing for attachment to the user with a ring 608. The other end of the elastic cord 602 may be attached at end 605 to a spooling device 606. The resistance shown is set in the least resistance configuration.

Figure 6B:
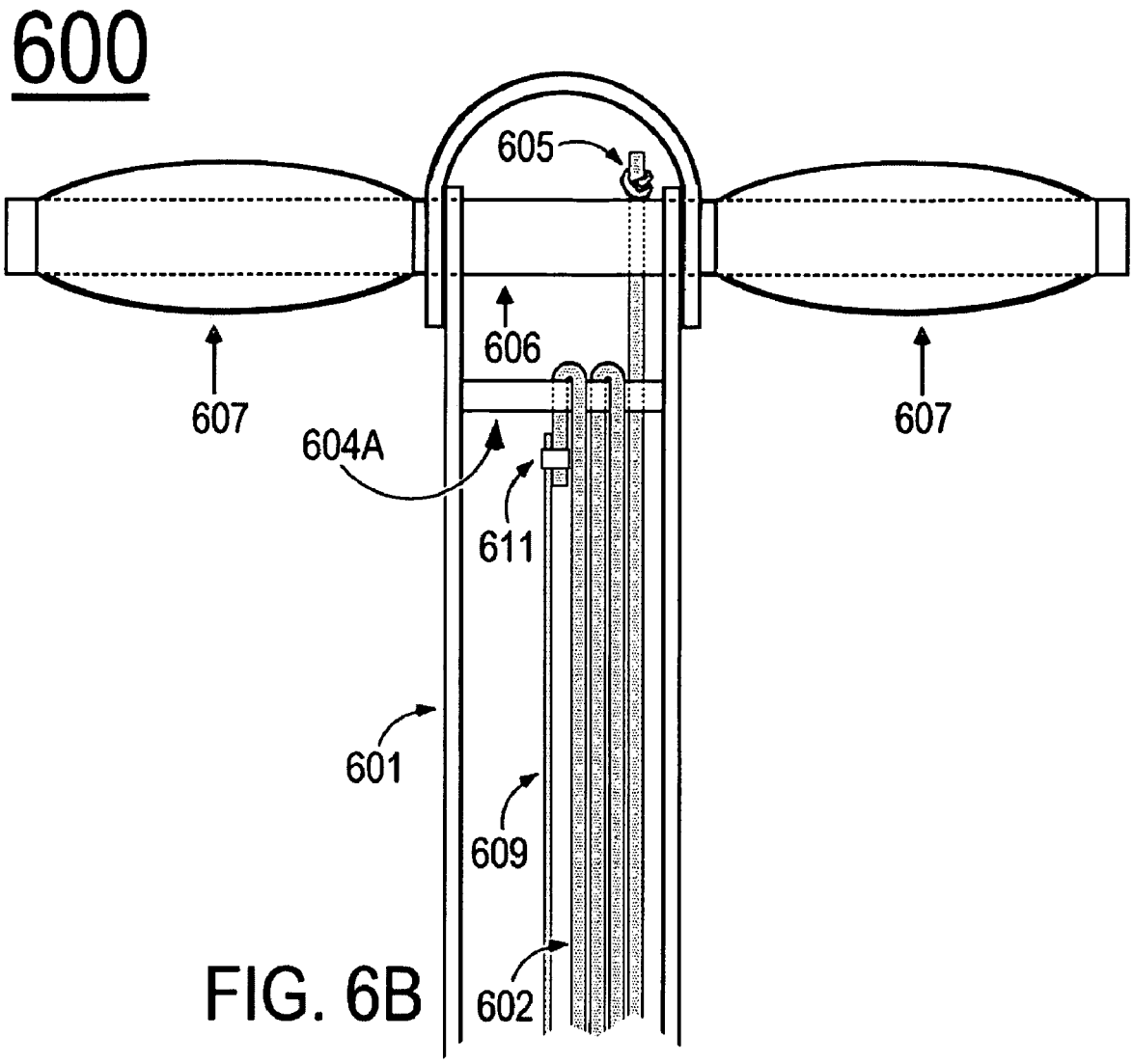

FIG. 6B depicts a schematic diagram of the upper portion of the embodiment in FIG. 6A, allowing for a more detailed viewing of the handle 607, spooling device 606, attachment at end 605 of the elastic cord 602 to the spooling device 606, attachment 611 of the non-elastic cord 609 to the end of the elastic cord 602 and configuration of the elastic cord 602 in the area of the supportive structure 604A.

Figure 6C:
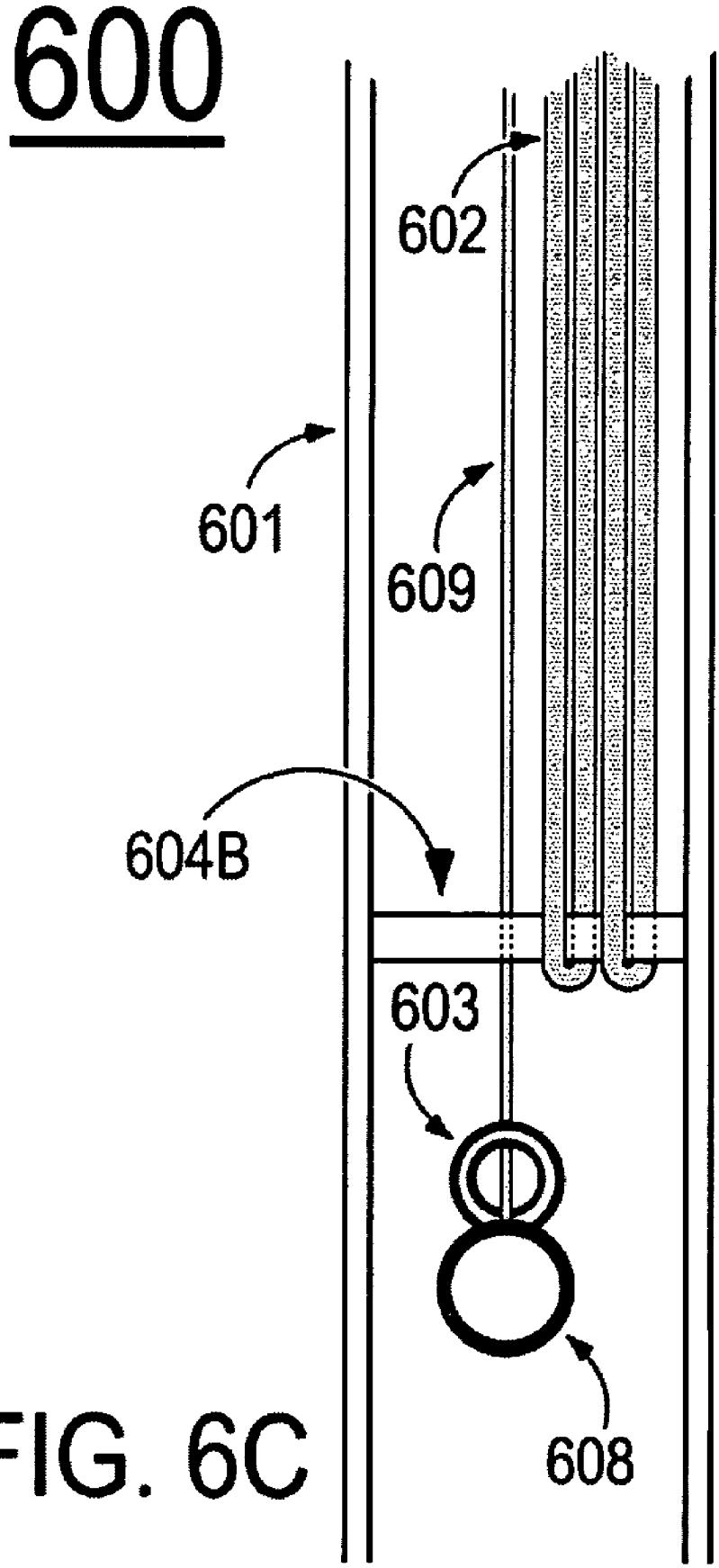

FIG. 6C depicts a schematic diagram of the lower portion of the embodiment in FIG. 6A, allowing for a more detailed viewing of the configuration of the elastic cord 602 and non-elastic cord 609, in the area of the supportive structure 604B, aperture 603 and attachment ring 608.

Figure 7A:
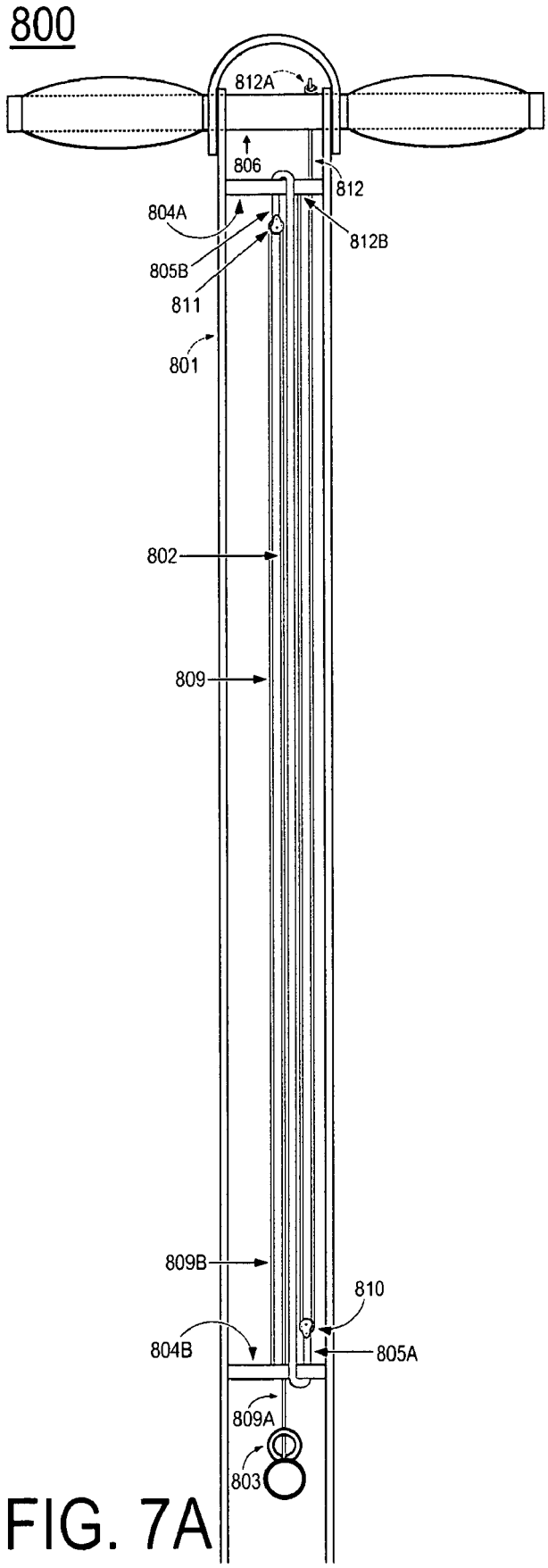
FIGS. 7A-C illustrate another embodiment of an exercise apparatus according to the invention.
Figure 7B:
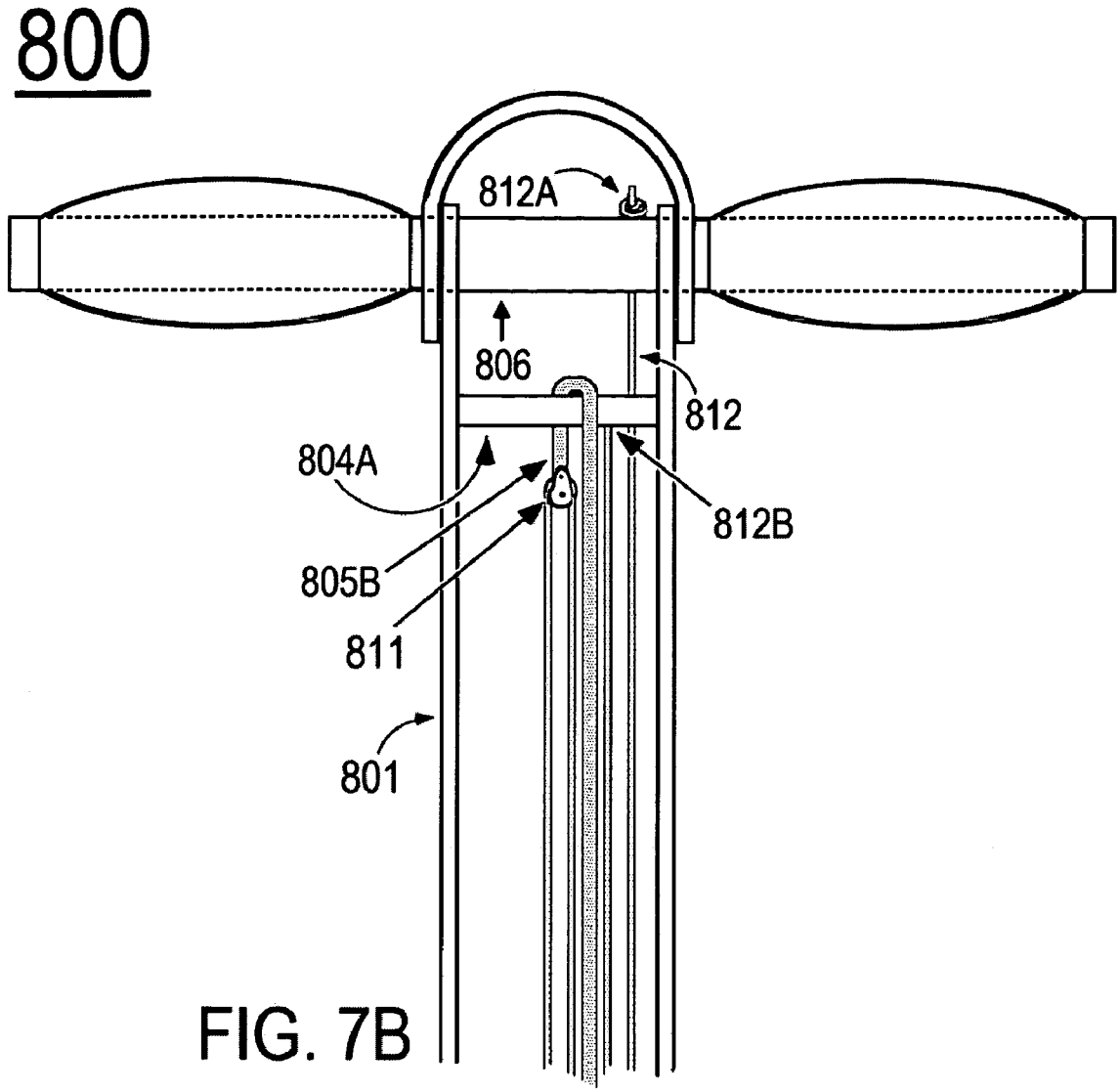
Figure 7C:
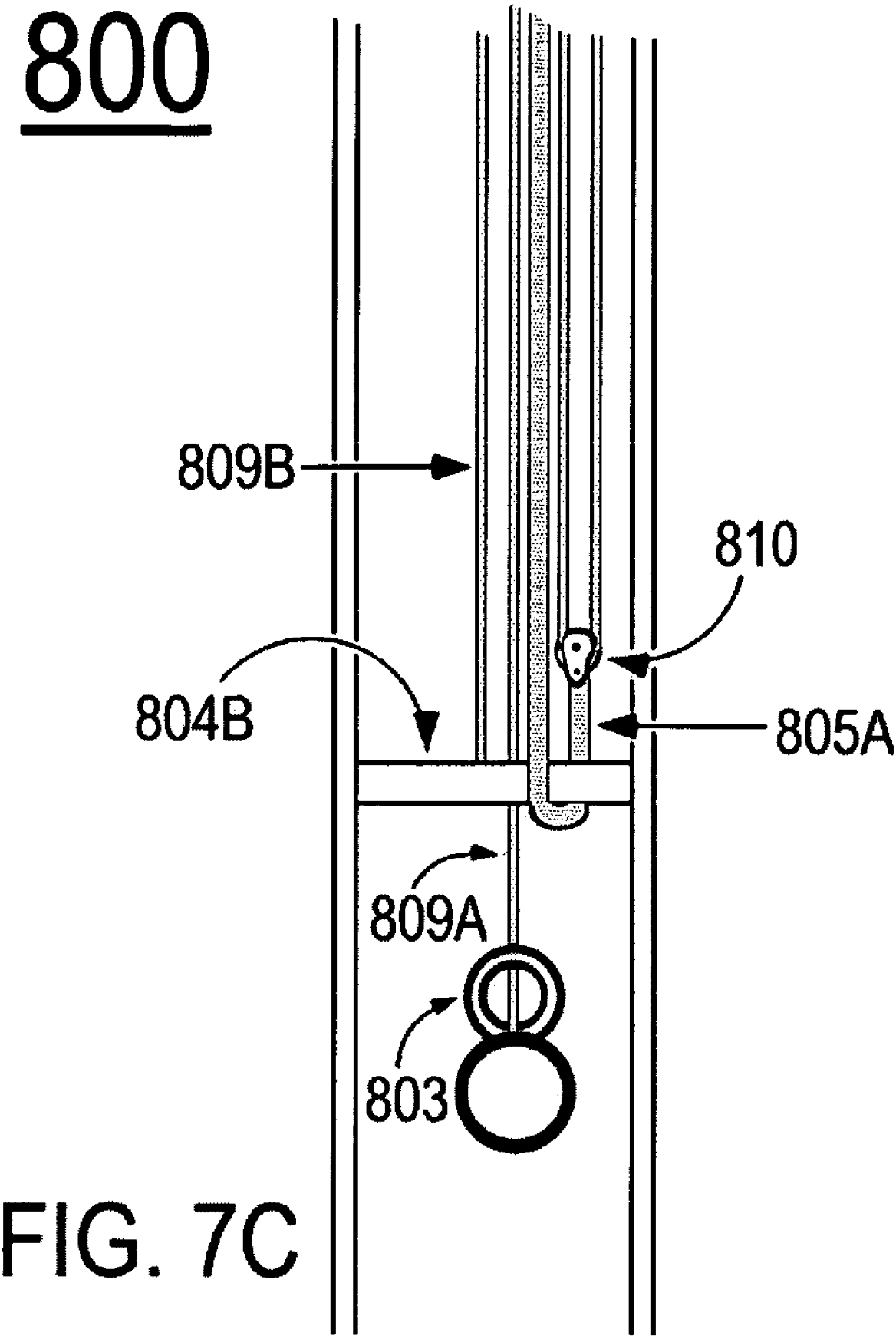

FIG. 7A illustrates another embodiment of a multi-functional exercise apparatus 800 with adjustable resistance. Exercise apparatus 800 may include a column, shown as housing 801, to which a spooling device 806 may be coupled. A cord 812 may be coupled to spooling device 806 at one end 812A, and to support structure 804A at 812B. Cord 812 may be mounted to a cord mounting structure, such as pulley 810, to which elastic member 802 may be in turn coupled at end 805A. Elastic member 802 may be coupled at another end 805B to another cord mounting structure such as pulley 811, on which cord 809 may be in turn mounted. Cord 809 may be coupled at end 809B to support structure 804B, and may at end 809A exit housing 801 from aperture 803. FIGS. 7B-C illustrate larger views of the upper and lower portions, respectively, of exercise apparatus 800.

Cords 812 and 809 may be constructed of various materials, and are preferably non-elastic. Cords 812 and 809 are also preferably mounted to cord mounting structures, such as pulleys 810 and 811, in a moveable manner. Exercise apparatus 800 may employ the use of cord 812 with pulley 810 without the use of cord 809 with pulley 811, or vice versa.

This configuration permits a significantly longer travel length of cord 809 outside housing 801, before pulley 811 reaches aperture 803. A larger diameter of elastic member 802 may be desired to offset the reduced resistance rendered by the addition of cord 809 and pulley 811. The coupling of cord 812 to elastic member 802 via pulley 810 aids in the relative ease of adjusting spooling device 806, as contrasted with a configuration in which elastic member 802 is coupled directly to spooling device 806.

Figure 8:
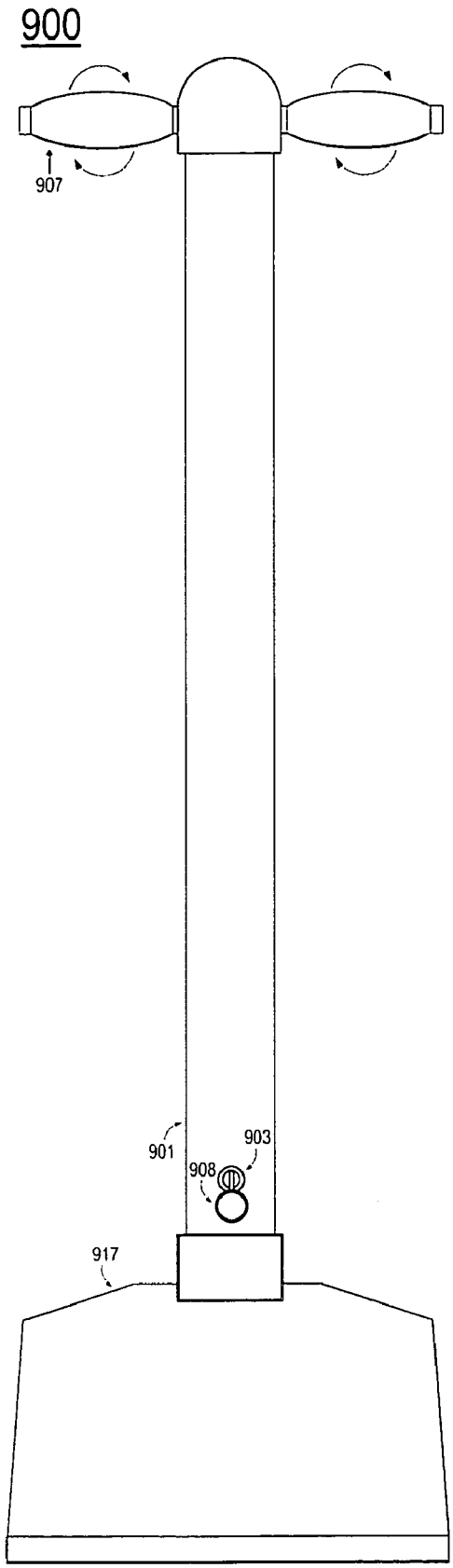
FIG. 8 illustrates another embodiment of an exercise apparatus according to the invention.

FIG. 8 depicts an embodiment of a multi-functional exercise apparatus 900 with adjustable resistance attached to a stable base unit 917. The base unit 917 may be stood upon by a user. The weight of the user may anchor the base unit 917 in position on a solid surface such as a floor or other area with adequate space to allow the user to operate the multi-functional exercise apparatus 900. The user may then attach himself to ring 908 attached to a cord exiting housing 901 through aperture 903 of multi-functional exercise apparatus 900, and perform various exercises by pulling on ring 908. The resistance and range of motion may then be adjusted by the user, by rotating handle 907.

Base 917 may optionally be made more compact or portable by being manufactured as two or more separate portions which may be separated or joined by the user as desired Base 917 may also be configured to be folded or, alternatively, laid out flat as desired. Also, other support structures may be optionally included to provide additional support or stability to the apparatus. For example, one or more stanchions (not shown) may be coupled to housing 901 and laid diagonally against the base 917 or floor upon which the apparatus rests.

Figure 9A:
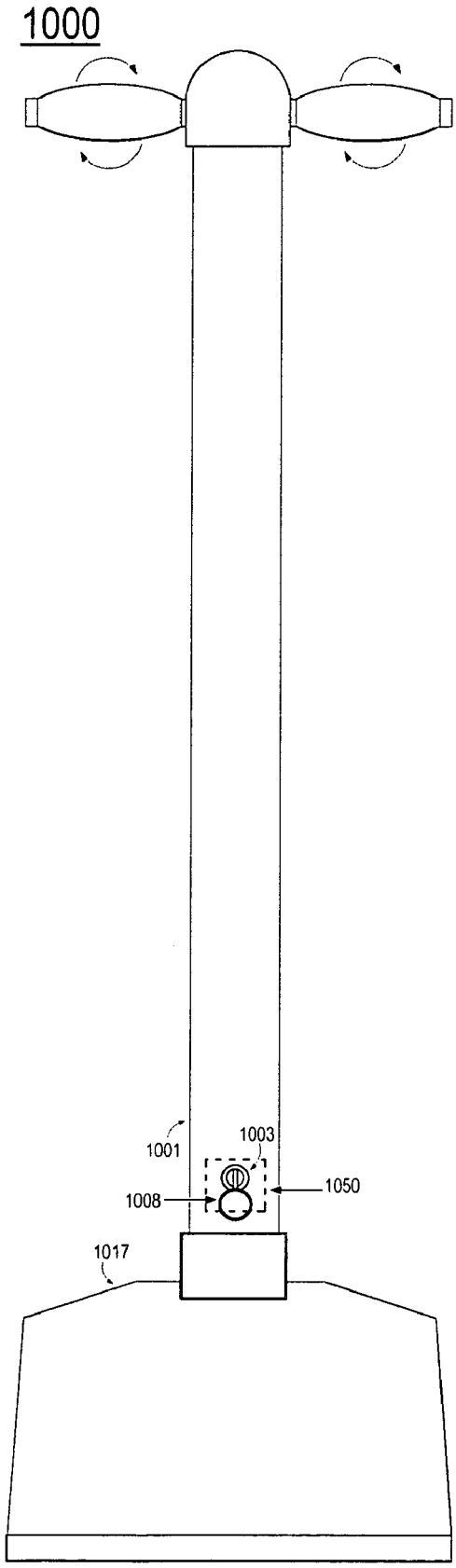
FIGS. 9A-B illustrate another embodiment of an exercise apparatus according to the invention.
Figure 9B:
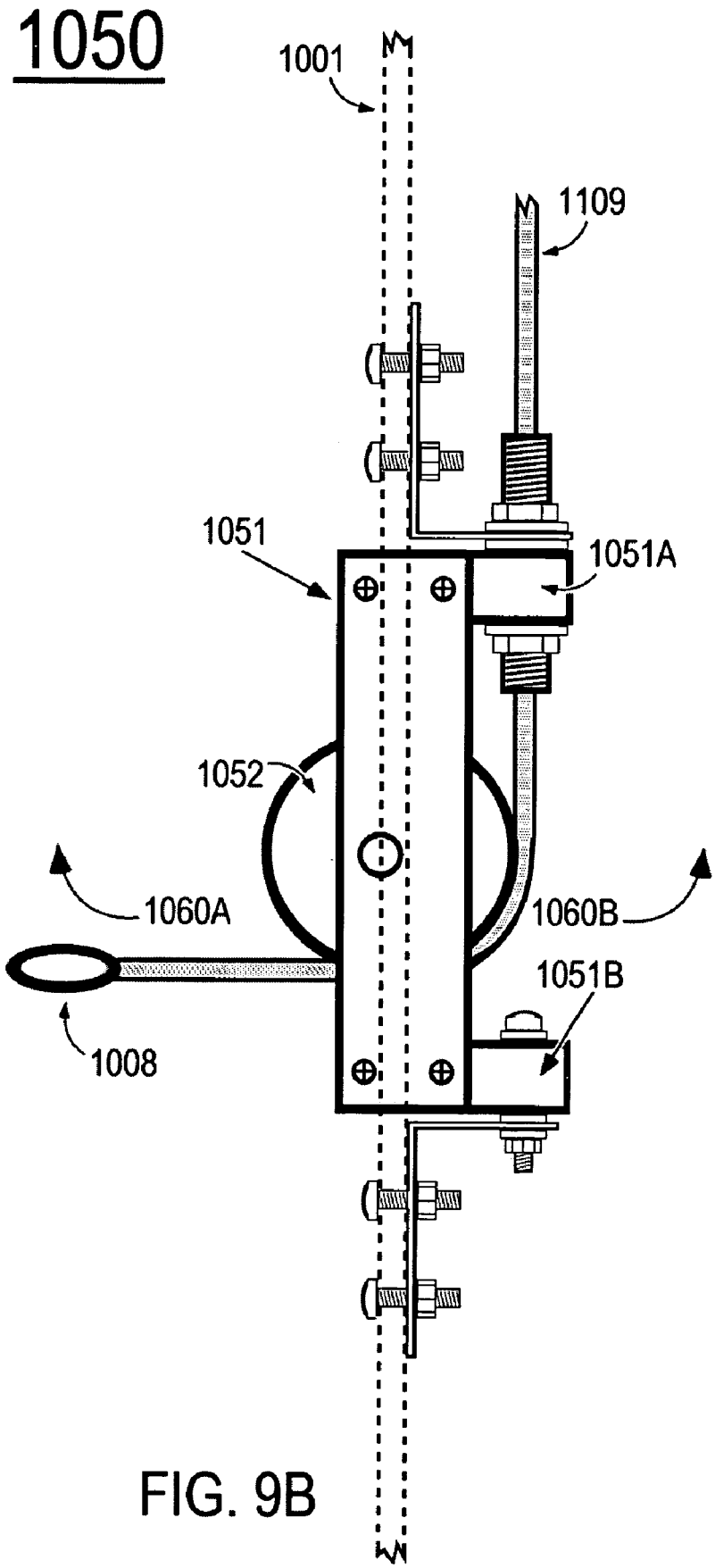

FIG. 9A illustrates yet another embodiment 1000 of a multi-functional exercise apparatus. Exercise apparatus 1000 includes swivel mechanism 1050, shown in detail in FIG. 9B. Swivel mechanism 1050 may be configured so that when a user pulls ring 1008 in a particular direction such as 1060A or 1060B, swivel mechanism 1050 will move in the same direction so that a cord or elastic member may exit aperture 1003 without friction against the edge of housing 1001 surrounding aperture 1003. This may not only prevent wear to the cord or elastic member, but also allow easier movement in directions 1060A-B for the user. For example, a user may be able to more easily maintain a position upon base unit 1017 while performing exercises of various angles and directions.

Swivel mechanism 1050 may include swivel housing 1051, rotatably coupled to housing 1001 at portions 1051A and 1051B. A cord 1109, for example, may pass through end 1051A to a cord mounting member such as pulley 1052, coupled to swivel housing 1051, upon which cord 1109 is mounted. The mounting and coupling of cord 1109, pulley 1052, and swivel housing 1051 to each other and housing 1001 may be accomplished via various methods of fastening known to one of ordinary skill in the art. In addition, a stopping device may be coupled to cord 1109 to the exterior of swivel housing 1051, so as to prevent at least a portion of the free end of cord 1109 to retract completely into housing 1001.

Figure 10A:
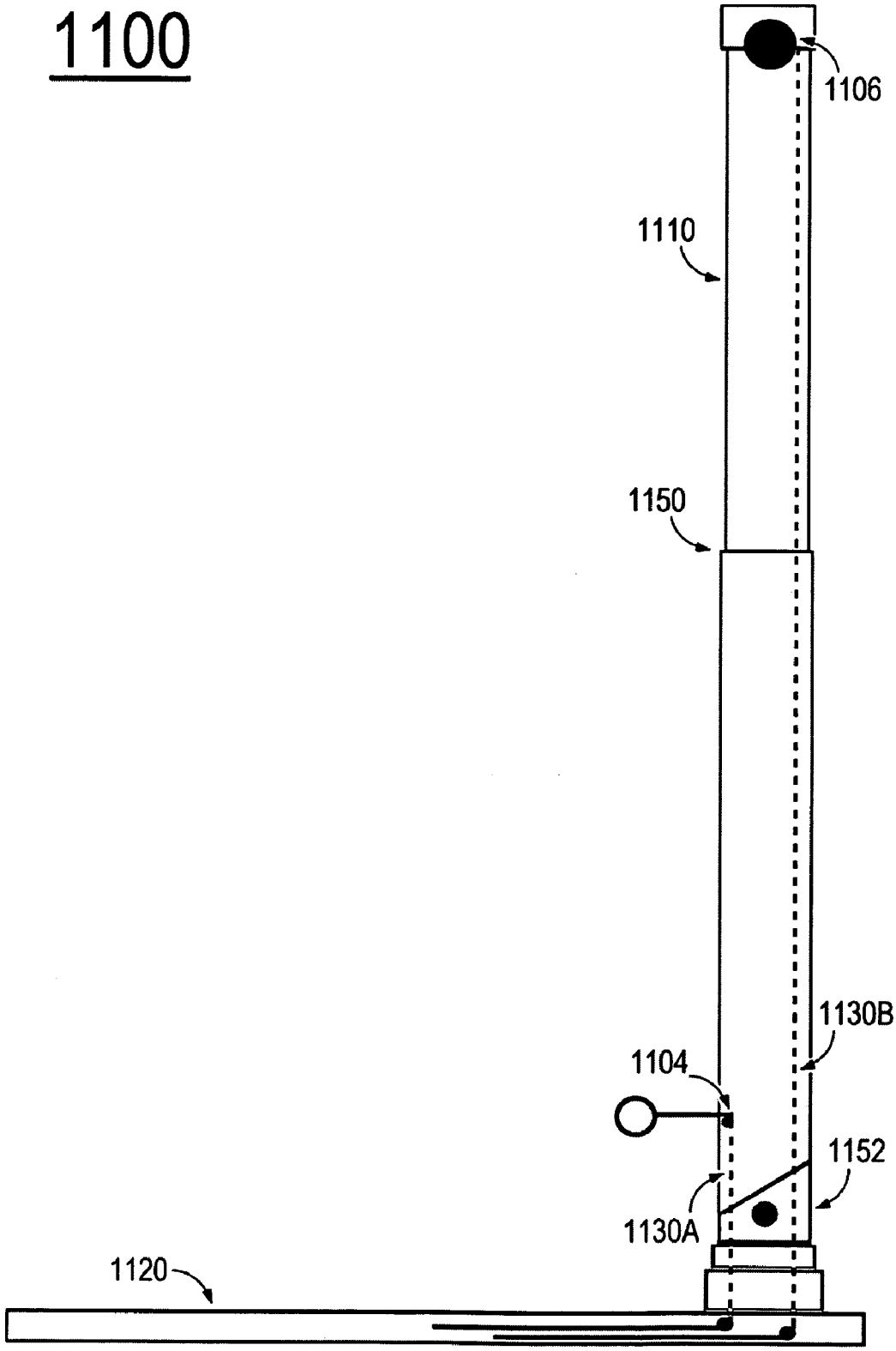
FIGS. 10A-C illustrate another embodiment of an exercise apparatus according to the invention.
Figure 10B:
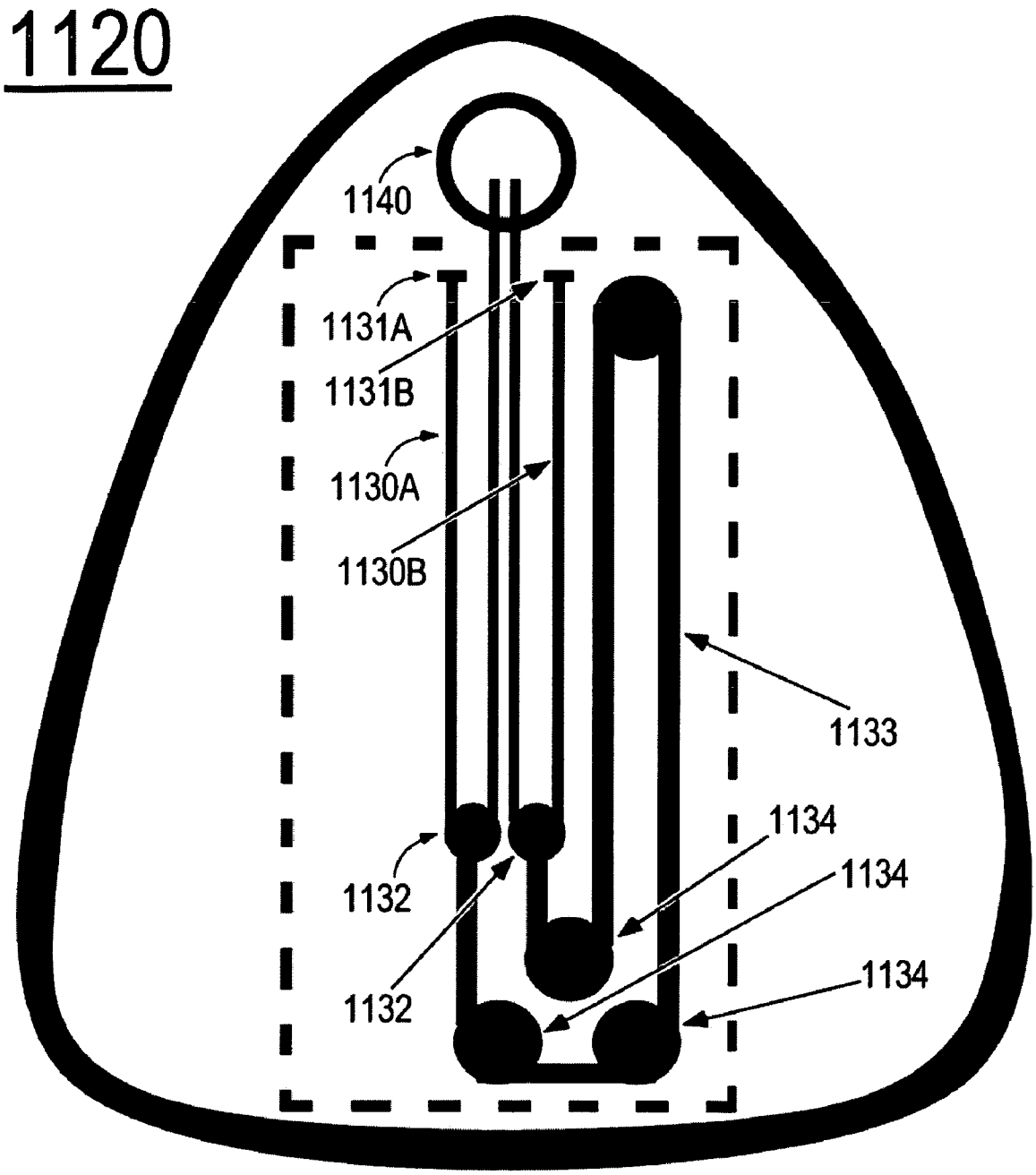

FIG. 10A illustrates another embodiment 1100 of a multi-functional exercise apparatus. Exercise apparatus 1100 includes housing 1110 coupled to a base 1120. In this embodiment, much of the cord mechanics, such as those described above in reference to FIGS. 1-9, are enclosed in the base 1120 instead of in the upright housing. As an example, FIG. 10B illustrates an embodiment of base 1120, which includes cords 1130A-B mounted on cord mounting members 1132, each coupled to an end or portion of elastic member 1133. Elastic member 1133 may be mounted on cord mounting members 1134 so as to organize the length of the elastic member 1133 in a compact configuration within the base 1120. One end of each of the cords 1130A-B may be coupled to the base at ends 1131A-B. The other end of each of the cords 1130A-B may exit the base via opening 1140, and into housing 1110, as illustrated in FIG. 10A. Cord 1130A may wrap over support structure 1104 and exit housing 1110. Cord 1130B may extend up to and be coupled to the spooling device 1106.

Since this above embodiment contains fewer materials within the housing 1110 portion of the apparatus, housing 1110 may optionally be configured to telescope, such as at joint 1150. Exercise apparatus 1100 may also be configured so that housing 1110 may pivot down towards, or completely separate from, base 1120, such as at joint 1152. These features may allow for more compact storage, easier portability, or smaller shipping size.

Figure 10C:
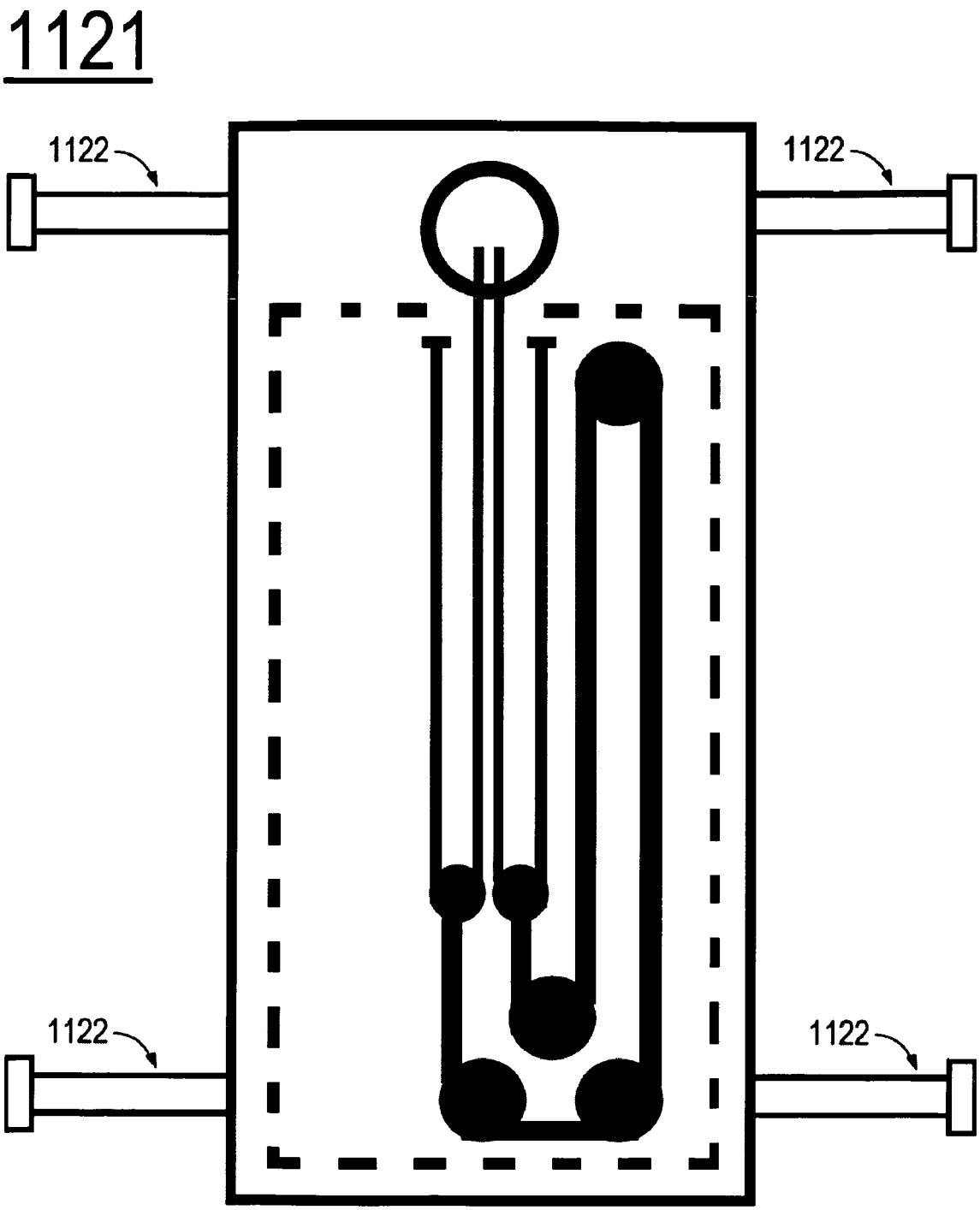

Additionally, base 1120 may be formed in one of various shape sand sizes, such as that shown in base 1121 of FIG. 10C. Legs 1122 may optionally be included for additional stability.

It should be noted that embodiments of the multi-functional exercise apparatus may be used for various exercises and activities. Hence, embodiments of the multi-functional exercise apparatus may have different shapes, sizes, components, and configurations. Some exemplary alternative embodiments in elude the following: a pad coupled to the housing so that a user can sit, lay or kneel on the apparatus; a bladder (e.g., similar to a portion of an exercise ball) coupled to the housing (e.g., on the top or on the bottom, or on a platform the exercise apparatus is attached to) to facilitate core stability exercises using the apparatus; a hinged, foldable, or otherwise collapsible housing to facilitate easy transportation and travel with the apparatus; mounting hardware to facilitate mounting the apparatus to a wall, a chair, a bench, or other exercise equipment; mechanical or electro-mechanical controls (i.e., an adjustment member) to control the movement of the adjustable spooling device or other method of altering the resting length of the elastic cord; electronics within the housing to facilitate guided workouts, gather historical data (e.g., counting reps and/or sets), provide audible or visual feedback, or implement a timer or counter; integrated handles, stirrups, or other contact grips, in place of the attachment ring; and coves within the perimeter of the housing or base unit to allow an attachment member to recess within the footprint of the housing. Moreover, other embodiments of the multi-functional exercise apparatus may implement various other components, features, or arrangements.

Thus, the invention provides a compact, portable, multi-functional exercise apparatus with variable resistance comprising a column to which a spooling device is coupled, and one or more elastic cords configured such that the spooling device may wind up the elastic cord, effectively reducing the apparent length of the elastic cord. The reduction in length of the elastic cord then produces an increased level of resistance at a given point of stretch from the point where the elastic cord exits the housing. A user can attach themselves to the exited cord and perform various resistance exercises such as, but not limited to, abdominal exercises, biceps exercises, wrist curls, abductor exercises, adductor exercises, ham string curls, leg extensions, squats, leg kickbacks, rows, etc. Resistance is infinitely adjustable as the handle is rotated and the effective length of the cord is altered, adapting to any individual resistance requirements specific to the user.

This has been illustrated in several embodiments that illustrate examples of applications of the invention in practical use situations. Although the above embodiments are described and illustrated in the context of exercise equipment, the scope of the invention extends to other applications where such functions are useful. Furthermore, while the foregoing description has been put forth with reference to particular embodiments of the invention, it will be appreciated that these are only illustrative of the invention and that changes may be made to those embodiments without departing from the principles of the invention as defined by the claims appended hereto and their equivalents.

What is claimed is:

1. An exercise apparatus with adjustable resistance, the exercise apparatus comprising:

a column;

a spooling device coupled to the column; and an elastic member coupled to the spooling device, wherein movement of the elastic member is permitted and the spooling device is configured to be rotatably adjustable to set a resistance associated with the elastic member prior to performing an exercise;

a first cord coupled to one end of the elastic member, wherein the first cord is mounted to the spooling device; and a second cord coupled to another end of the elastic member.

2. An exercise apparatus with adjustable resistance, the exercise apparatus comprising:

a column;

a spooling device coupled to the column; and an elastic member coupled to the spooling device, wherein movement of the elastic member is permitted and the spooling device is configured to be rotatable adjustable to set a resistance associated with the elastic member prior to performing an exercise;

a first support structure coupled to the column; and a second support structure coupled to the column, wherein the elastic member is wrapped about the first and second support structures, and the elastic member is configured to pull against the first and second support structures when a free portion of the elastic member is pulled.

3. The exercise apparatus of claim 2, wherein the elastic member is mounted to the spooling device at one end of the elastic member, and the free portion is an opposing end to the one end.

4. The exercise apparatus of claim 2, wherein the first support structure is disposed in proximate relation to the spooling device, and the second support structure is disposed in remote relation to the spooling device.

5. The exercise apparatus of claim 4, wherein the first support structure is substantially parallel to the spooling device, and the second support structure is substantially orthogonal to the spooling device.

6. The exercise apparatus of claim 2, wherein the elastic member is mounted to the spooling device at one end of the elastic member, and further comprising:

a cord mounting structure coupled to another end of the elastic member; and a cord, wherein a first end of the cord is mounted on the second support structure and a portion of the cord is mounted on the cord mounting structure between the first end and a second end of the cord.

7. The exercise apparatus of claim 2, further comprising:

a cord mounting structure coupled to one end of the elastic member; and a cord, wherein a first end of the cord is mounted on the first support structure, a second end of the cord is mounted to the spooling device, and a portion of the cord is mounted on the cord mounting structure between the first end and the second end.

8. The exercise apparatus of claim 2, further comprising:

a first cord mounting structure coupled to one end of the elastic member;

a first cord, wherein a first end of the first cord is mounted on the first support structure, a second end of the first cord is mounted to the spooling device, and a portion of the first cord is mounted on the first cord mounting structure between the first end and the second end of the first cord;

a second cord mounting structure coupled to another end of the elastic member; and a second cord, wherein a first end of the second cord is mounted on the second support structure and a portion of the second cord is mounted on the second cord mounting structure between the first end and a second end of the second cord.

9. The exercise apparatus of claim 8, wherein the first end of the first cord is fixedly mounted on the first support structure, the portion of the first cord is moveably mounted on the first cord mounting structure, the first end of the second cord is fixedly mounted on the second support structure, and the portion of the second cord is moveably mounted on the second cord mounting structure.

10. An exercise apparatus with adjustable resistance, the exercise apparatus comprising:

an elongated housing;

a spooling device coupled to the housing;

an elastic member disposed substantially within the housing and coupled to the spooling device, wherein movement of the elastic member is permitted and the spooling device is configured to be rotatable adjustable to determine a resistance associated with the elastic member prior to performing an exercise;

an inner surface of the housing defining an aperture; and a swivel mechanism disposed about the housing, wherein the swivel mechanism is configured to rotate about an axis of the housing.

11. The exercise apparatus of claim 10, wherein the swivel mechanism includes a swivel housing rotatably coupled to the housing of the exercise apparatus.

12. The exercise apparatus of claim 10, wherein the swivel mechanism further includes a cord mounting member coupled to the swivel housing, configured so that the elastic member may be mounted on the cord mounting member and exit the housing from the cord mounting member.

13. An exercise apparatus with adjustable resistance, the exercise apparatus comprising:

a base;

a housing coupled to the base about an end of the housing, wherein the housing is substantially orthogonal to the base;

a spooling device coupled to the housing;

an elastic member disposed substantially within the housing and the base, and coupled to the spooling device, wherein movement of the elastic member is permitted and the spooling device is configured to be rotatably adjustable to limit the movement of the elastic member; and an inner surface of the housing defining an aperture.

14. The exercise apparatus of claim 13, wherein the elastic member is configured to exit the housing through the aperture.

15. The exercise apparatus of claim 13, wherein the base includes a cord mounting structure around which the elastic member is movably mounted.

16. The exercise apparatus of claim 13, wherein the base includes an inner surface defining an opening through which the elastic member is configured to pass into the housing.

17. An apparatus, comprising:

a column;

a spooling device coupled to the column; and an elastic member coupled to the spooling device, wherein movement of the elastic member is permitted and the spooling device is configured to be rotatably adjustable to set a resistance provided by the elastic member prior to operating the apparatus;

a first cord coupled to one end of the elastic member, wherein the first cord is mounted to the spooling device; and a second cord coupled to another end of the elastic member.

* * * * *